US007010256B2

(12) United States Patent
Usui et al.

(10) Patent No.: US 7,010,256 B2
(45) Date of Patent: Mar. 7, 2006

(54) IMAGE HEATING APPARATUS HAVING RECORDING MEDIUM CONVEYING NIP NONUNIFORM IN PRESSURE DISTRIBUTION

(75) Inventors: Masatake Usui, Susono (JP); Hideyuki Yano, Mishima (JP); Kenya Ogawa, Mishima (JP); Katsuhiko Oba, Odawara (JP); Shunichi Ebihara, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 58 days.

(21) Appl. No.: 10/705,975

(22) Filed: Nov. 13, 2003

(65) Prior Publication Data

US 2005/0105941 A1 May 19, 2005

(30) Foreign Application Priority Data

Nov. 14, 2002 (JP) ..... 2002-330389
Nov. 29, 2002 (JP) ..... 2002-348473

(51) Int. Cl.
*G03G 15/20* (2006.01)

(52) U.S. Cl. ..... 399/328; 219/216; 399/329

(58) Field of Classification Search ..... 399/328, 399/329, 322, 320; 219/216, 619, 243; 347/156; 430/124, 105, 111.4
See application file for complete search history.

(56) References Cited

U.S. PATENT DOCUMENTS 5,053,829 A * 10/1991 Field et al. ..... 399/329
5,177,549 A 1/1993 Ohtsuka et al. ..... 399/320
5,264,902 A 11/1993 Suwa et al. ..... 399/333
5,267,005 A * 11/1993 Yamamoto et al. ..... 399/329
5,319,425 A * 6/1994 Forlani ..... 399/328
5,525,775 A 6/1996 Setoriyama et al. ..... 219/216
5,552,582 A 9/1996 Abe et al. ..... 219/619
5,862,445 A 1/1999 Ogawa et al. ..... 399/329
5,874,710 A * 2/1999 Yoshimoto et al. ..... 219/216
5,942,366 A * 8/1999 Ohno et al. ..... 430/125
6,090,516 A * 7/2000 Choe et al. ..... 430/111.4 X
6,385,428 B1 5/2002 Uchida et al. ..... 399/303
6,564,033 B1 5/2003 Zhou et al. ..... 399/329
6,627,368 B1 * 9/2003 Okubo et al. ..... 430/108.23
2002/0146259 A1 * 10/2002 Zhou et al. ..... 399/329
2003/0002895 A1 1/2003 Kato et al. ..... 399/333
2003/0077092 A1 4/2003 Ogawa et al. ..... 399/328

FOREIGN PATENT DOCUMENTS

JP 4-44075 2/1992
JP 2001-324886 A * 11/2001

* cited by examiner

*Primary Examiner*—Sophia S. Chen
(74) *Attorney, Agent, or Firm*—Fitzpatrick, Cella, Harper & Scinto

(57) ABSTRACT

An image heating apparatus has a flexible rotatable member; a slidable member for sliding contact with an inner surface of the rotatable member; a back-up member for forming a nip with the slidable member with the rotatable member interposed therebetween, wherein a projection extended along a longitudinal direction of the rotatable member, and provided on such a portion of a sliding surface of the slidable member as is downstream of a center of the sliding surface with respect to a recording material feeding direction in which the recording material is fed, and wherein the projection is effective to provide a maximum pressure in a distribution, with respect to the recording material feeding direction, of pressure applied to the nip.

4 Claims, 17 Drawing Sheets

IMAGE HEATING APPARATUS HAVING RECORDING MEDIUM CONVEYING NIP NONUNIFORM IN PRESSURE DISTRIBUTION

FIELD OF THE INVENTION AND RELATED ART

The present invention relates to an image heating apparatus usable, with preferable results, as a fixing apparatus for effecting a permanent image on a recording medium, by applying pressure and heat to the recording medium bearing an unfixed image, in an electrophotographic image forming apparatus, an electrostatic recording apparatus, etc.

In recent years, colorization has been in progress in the field of an image forming apparatus, such as a printer, a copying machine, etc. As a fixing apparatus employed by a color image forming apparatus, a fixing apparatus employing, as a fixing member, a heat roller having an elastic layer has been well-known. Such a fixing apparatus is structured so that a transfer medium P (recording medium) bearing an unfixed toner image is conveyed through the contact nip formed by two heat rollers, that is, a temperature-controlled fixation roller and a pressure roller. While the unfixed toner image is conveyed through the nip, heat and pressure is applied to the unfixed toner image, being thereby fixed, as a finished image, to the transfer medium.

Also in recent years, it has become important that an image forming apparatus can operate on demand. From the standpoint of the ability to start up quickly, and energy conservation, a fixing apparatus employing a film heating method (for example, Japanese Laid-open Patent Application 4-44075), a fixing apparatus employing induction heating method, that is, a method in which heat is generated by a film itself, and the like fixing apparatuses, have been put to practical usage. In the case of the fixing apparatus employing an induction heating method, the heating film itself generates heat, improving thereby the efficiency with which the consumed energy is utilized, and also, making it possible for the apparatus to fix an image at a higher speed.

Further, in recent years, a color image forming apparatuses has come to be required of the function of achieving a higher level of glossiness when outputting a photographic image or the like.

A glossiness value, which indicates the level of glossiness, is determined by the condition of a fixing apparatus by which an unfixed image on a transfer medium is fixed. As one of the methods for increasing the glossiness value, it is possible to raise the fixation temperature.

However, if the fixation temperature is set high, the toner particles on a recording medium are excessively heated, becoming therefore drastically low in viscosity. As a result, when a transfer medium separates from a heating member, at the downstream end of the fixation nip, some of the toner particles having just been fixed to the recording medium agglomerate, partially destroying the toner layer, and transfer onto the healing member (hereinafter, this phenomenon will be referred to as "hot offset"). The toner particles having transferred onto the heating member adhere back to the transfer medium, soling thereby the image on the transfer medium, during the following rotation of the heating member. In other words, in the case of a conventional fixing apparatus, the highest temperature at which the apparatus can be operated without yielding an image of inferior quality coincides with the temperature above which "hot offset" occurs.

SUMMARY OF THE INVENTION

The present invention was made in consideration of the above described problems, and its primary object is to provide an image heating apparatus capable of yielding an image, the glossiness level of which is higher than that of an image yielded by a conventional image heating apparatus.

Another object of the present invention is to provide an image heating apparatus capable of yielding an image with a higher level of glossiness than that achievable by a conventional image heating apparatus, without being set to a higher degree of temperature.

Another object of the present invention is an image heating apparatus comprising:

a flexible and circularly drivable member;

a slippery member placed in contact with the inward surface of the circularly drivable member; and a backup member which is pressed against the slippery member, with the interposition of the circularly drivable member, forming a nip (sheet nipping portion) through which a recording medium is conveyed to heat the image on the recording medium, with the heat from the circularly drivable member;

wherein, the slippery member is provided with a ridge, which is located on the surface, on which the circularly drivable member slides, downstream of the center of the slippery member, in terms of the recording medium conveyance direction, and extends in the lengthwise direction of the circularly drivable member; and the fixation pressure in the nip is highest at the point in the nip corresponding in position to the ridge.

Another object of the present invention is an image heating apparatus comprising:

a flexible and circularly drivable member;

a slippery member placed in contact with the inward surface of the circularly drivable member; and a backup member which is pressed against the slippery member, with the interposition of the circularly drivable member, forming a nip (sheet nipping portion) through which a recording medium is conveyed to heat the image on the recording medium, with the heat from the circularly drivable member; and a ridge which is located on the surface of the slippery member, on which the circularly drivable member slides, downstream of the center of the slippery member, in terms of the recording medium conveyance direction, and extends in the lengthwise direction of the circularly drivable member;

wherein, the fixation pressure in the nip is highest at the point in the nip corresponding in position to the ridge.

Another object of the present invention is an image heating apparatus comprising:

a flexible and circularly drivable member;

a slippery member placed in contact with the inward surface of the circularly drivable member; and a backup member which is pressed against the slippery member, with the interposition of the circularly drivable member, forming a nip (sheet nipping portion) through which a recording medium is conveyed to heat the image on the recording medium, with the heat from the circularly drivable member; and a rotational member disposed within the nip range, downstream of the slippery member in terms of the recording medium conveyance direction;

wherein, the fixation pressure in the nip is highest at the point in the nip corresponding in position to the rotational member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Image Forming Apparatus

Figure 1:
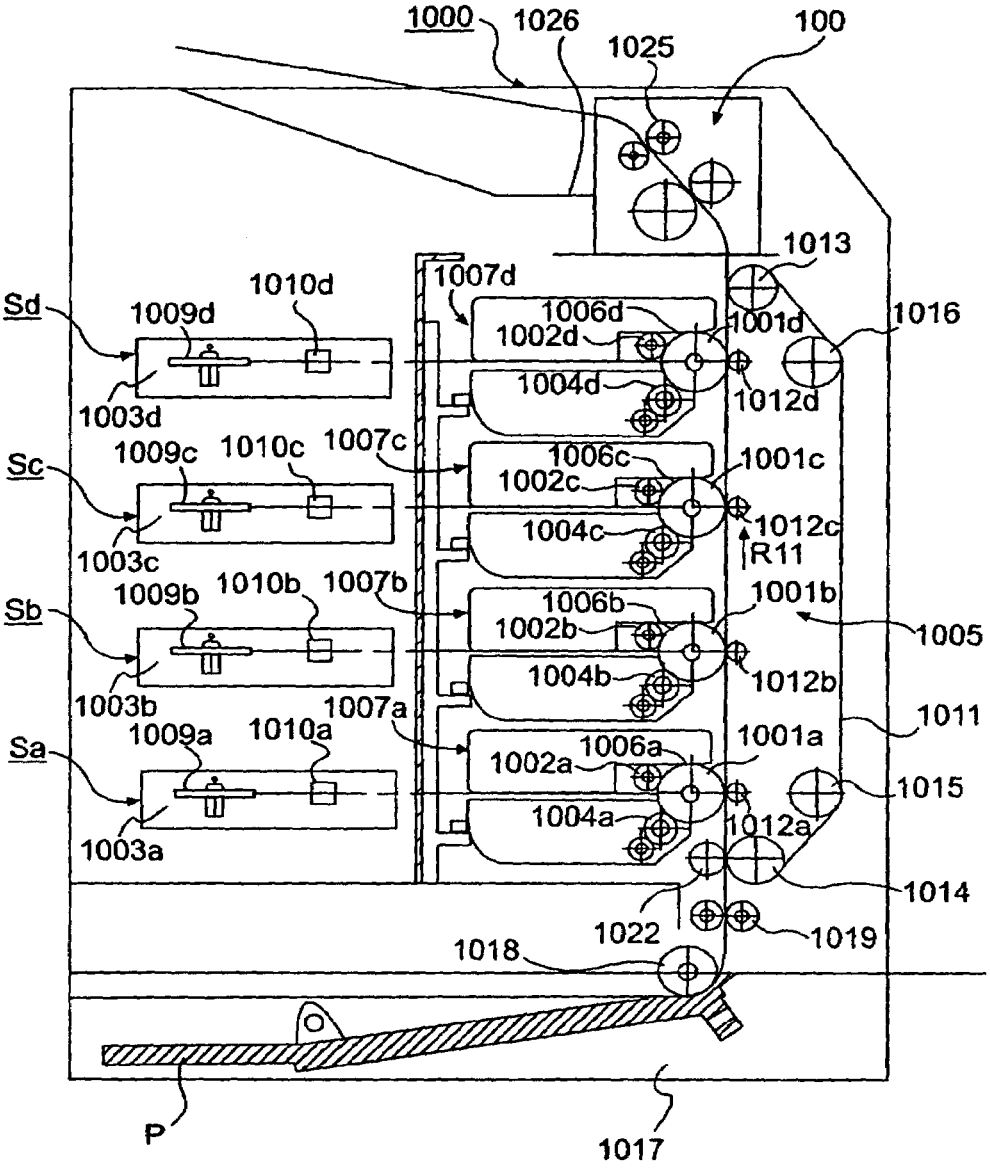
FIG. 1 is a schematic sectional view of the image forming apparatus in the first embodiment of the present invention.

Shown in FIG. 1 is an example of the image forming apparatus equipped with the fixing apparatus, as an image heating apparatus, in accordance with the present invention. The image forming apparatus in this drawing is an electrophotographic full-color laser printer. FIG. 1 is a vertical sectional view of the apparatus, showing the general structure thereof. Incidentally, in this embodiment, an image forming apparatus means, in addition to an electrophotographic laser printer, an electrophotographic copying machine, and an electrophotographic facsimileing machine, etc. It also includes an electrostatic printer, an electrostatic copying machine, an electrostatic facsimileing machine, etc.

The main assembly 100 of the laser printer (which hereinafter may be referred to as "image forming apparatus") shown in FIG. 1 has four processing stations (image formation stations) Sa, Sb, Sc, and Sd, listing from the downstream side in terms of the direction in which a transfer medium (recording medium) P is conveyed in the main assembly 100 of the image forming apparatus, which form cyan, yellow, magenta, and black toner images, respectively.

Next, the components of the image forming apparatus will be described, starting from the photoconductive drums 1001*a*–1001*d*.

The photosensitive drums 1001*a*–1001*d* comprise a cylinder with a diameter of 30 mm, formed of aluminum, for example, and a layer of photosensitive organic semiconductor (OPC layer) coated on the peripheral surface of the cylinder. The photosensitive drums 1001*a*–1001*d* are rotationally supported by their lengthwise end portions, by their own pairs of supporting members (unshown). They are rotationally driven in the counterclockwise direction of FIG. 1, by the driving force transmitted to one of the lengthwise end portions of each of the photosensitive drums 1001*a*–1001*d*.

The charging apparatuses 1002*a*–1002*b* have a charge roller (electrically conductive roller) and a charge bias application power source (unshown). The charging apparatuses 1002*a*–1002*d* are placed in contact with the peripheral surfaces of the photosensitive drums 1001*a*–1001*b*, respectively. As charge bias is applied to the charge rollers 1002*a*–1002*d* by the above described charge bias application power sources, respectively, the peripheral surfaces of the photosensitive drums 1001*a*–1001*d* are uniformly charged to the predetermined polarity and potential level. In this embodiment, the peripheral surfaces of the photosensitive drums 1001*a*–1001*d* are uniformly charged to the negative polarity by the charging apparatuses 1002*a*–1002*d*, respectively.

The exposing apparatuses 1003*a*–1003*d* are disposed leftward of the corresponding photosensitive drums 1001*a*–1001*d* shown in FIG. 1. In operation, a beam of light emitted from the laser diode (unshown) of each exposing means, while being modulated with image formation signals, is projected onto the corresponding polygon mirror 1009 (1009*a*–1009*d*) being rotated at a high speed by a scanner motor, and is reflected by the polygon mirror 1009 toward the focusing lens 1010 (1010*a*–1010*d*). Thus, the beam of light is focused by the polygon mirror 101 on the portion of the peripheral surface of the photoconductive drum 1001, which has just been charged. As a result, numerous points on this portion of the peripheral surface of the photosensitive drum 1001 are selectively exposed, effecting thereby an electrostatic latent image on the portion. In this embodiment, the points to which toner is to adhere are partially reduced in the amount of electrical charge.

The developing apparatuses 1004*a*, 1004*b*, 1004*c*, and 1004*d* each comprise: a toner container, in which toner (cyan, yellow, magenta, and black toners, respectively) is stored, respectively; an elastic development roller, which is placed in contact with the corresponding photosensitive drum; and an elastic supply roller which is placed in contact with the development roller. As the supply roller bearing toner on its peripheral surface rubs against the development roller, the some of the toner particles on the supply roller are transferred onto the peripheral surface of the development roller while being electrically charged by the friction. The development roller, onto which the toner particles have just been transferred while being electrically charged by friction, is in contact with the photosensitive drum, on which an electrostatic latent image has just been formed, across the charged portion thereof. Thus, as development bias is applied to the development roller by the development bias application power source (unshown), the negatively charged toner particles on the development roller adhere to the points with the reduced amount of electrical charge, on the charged portion of the peripheral surface of the photosensitive drum 1001 (1001*a*–1001*d*); the electrostatic latent image on the photosensitive drum 1001 is developed into a visible image formed of the toner particles.

All the developing apparatuses 1004*a*, 1004*b*, 1004*c*, and 1004*d* are the same in the structure and function for development.

Each of the above described photosensitive drum, corresponding charging apparatus and developing apparatus, and a cleaning apparatus, are integrally disposed in a cartridge, so that they can be removably mounted in the main assembly of an image forming apparatus.

On the leftward of the set of process cartridges 1007*a*, 1007*b*, 1007*c*, and 1007*d*, shown in FIG. 1, a transferring apparatus 1005 is disposed, which comprises a conveyer belt (transfer medium conveying number) 1011 that is, an electrostatic conveyer belt. The conveyer belt 1011 is circularly driven in contact with the photosensitive drums 1001*a*, 1001*b*, 1001*c*, and 1001*d*. It is formed of a piece of film, the volume resistivity of which is in the range of $10^8$–$10^{13}$ Ω·cm, and the thickness of which is in the range of 50–300 μm. The conveyer belt 1011 in this embodiment is formed of a piece of PvdF (polyvinylidene flouride) film which is roughly 100 μm in thickness, and has a volume resistivity of $10^{11}$ Ω·cm.

The conveyer belt 1011 is vertically stretched around four rollers 1013, 1014, 1015, and 1016, which are disposed in parallel. As it is rotationally driven in direction R11, the transfer medium P is kept electrostatically adhered to the outward surface thereof with respect to the loop it forms, in the range between the rollers 1013 and 1014 shown in FIG. 1. Thus, the transfer medium P is conveyed through the transfer stations, that is, the contact areas between the photosensitive drums 1001*a*–1001*d*, and the conveyer belt 1011. As a result, the toner images on the photosensitive drums 1001*a*–1001*d*, one for one, are sequentially transferred onto the transfer medium P on the conveyer belt 1011, by the transfer rollers 1012*a*, 1012*b*, 1012*c*, and 1012*d*, respectively, which will be described next.

There are disposed the four transfer rollers 1012*a*, 1012*b*, 1012*c*, and 1012*d*, on the inward side of the loop formed by the conveyer belt 1011. They oppose the photosensitive drums 1001*a* 1001*b*, 1001*c*, and 1001*d*, respectively, with the transfer rollers 1012*a*–1012*d* placed in contact with the inward surface of the conveyer belt 1011 with respect to the loop formed by the conveyer belt 1011, and the conveyer belt 1011 sandwiched between the photosensitive drums 1001*a*–1001*d*, and the transfer rollers 1012*a*–1012*d*, respectively.

In this embodiment, positive voltage as transfer bias is applied to the transfer rollers 1012*a*–1012*d* from the transfer bias application power source (unshown). As a result, the toner images on the photosensitive drums 1001*a*–1001*d*, one for one, which are negative in polarity, are sequentially transferred onto the transfer medium P in the first to fourth transfer stations, respectively.

The residual toner particles, that is, the toner particles which remained on the photosensitive drums 1001*a*–1001*d*, without being transferred onto the transfer medium P while the toner images were transferred, are removed by the cleaning apparatuses 1006*a*–1006*d*, respectively.

There is a sheet feeder cassette 1017 in the bottom portion of the main assembly 100 of the image forming apparatus. The cassette 1017 is removably mountable in the main assembly 100. It contains multiple transfer mediums P (for example, ordinary papers, envelops, transparent films, etc.), which are placed in layers. As the sheet feeder roller 1018 (semilunar roller) is rotated, the transfer mediums P in the sheet feeder cassette 1017 are fed out of the sheet feeder cassette 1017 while being separated one by one from the transfer mediums P thereunder. As the leading end of each transfer medium P comes into contact with the pair of registration rollers 1019, the transfer medium P is temporarily stopped, being thereby forced to slightly arcuate. Then, the transfer medium P is released by the pair of registration rollers 1019 toward the conveyer belt 1011, in synchronism with the formation of images on the photosensitive drums 1001*a*–1001*d*, so that the arrival of the transfer medium P at the first to fourth transfer stations coincides with the arrival of the images on the photosensitive drums 1001*a*–1001*d* at the first to fourth transfer stations, respectively. After being released toward the conveyer belt 1011 by the pair of registration rollers 1019, the transfer medium P is adhered to the surface of the conveyer belt 1011 by the adhesion roller 1022, as an adhering member, disposed on the further upstream of the photosensitive drum 1001*a*, that is, the most upstream photosensitive drum, in terms of the transfer medium conveyance direction.

There is the fixing apparatus 100 on the further downstream (upward) of the process station Sd, that is the most downstream process station. The fixing apparatus 100 is for fixing to the transfer medium P, the multiple toner images which have just been transferred onto the transfer medium P. It will be described later in more detail.

In the image forming operation of the above described image forming apparatus, the following nine steps 1)–9) are sequentially carried out.

1) The photosensitive drums 1001*a*–1001*d* in the process cartridges 1007*a*–1007*d*, respectively, are rotationally driven in the counterclockwise direction in synchronism with the timing of the image forming operation, while being uniformly charged by the charging apparatuses 1002*a*–1002*d*, respectively.

2) After being charged, the photoconductive drums 1001*a*–1001*d* are exposed by the exposing apparatuses 1003*a*–1003*d*, respectively, in accordance with image formation signals (image formation data). As a result, an electrostatic latent image is formed on each of them. More specifically, as a given point on the charged portion of the peripheral surface of each photosensitive drum is not exposed, the potential level of this point remains at VD (high voltage level point: dark point). On the other hand, as a given point on the charged portion of the peripheral surface of the photosensitive drum is exposed, the potential level of this point is reduced to VL (low potential level: light point).

3) The developing apparatuses 1004*a*–1004*d* adhere toner particles to the above described light points of the electrostatic latent images on the photosensitive drums 1001*a*–1001*d*, forming thereby cyan, yellow, magenta, and black toner images thereon, respectively.

4) Meanwhile, the transfer medium P having been delivered from the sheet feeder cassette 1007 to the conveyer belt 1011, by the sheet feeder roller 1018, pair of registration rollers 1019, etc., is sandwiched between the adhesion roller 1022 and conveyer belt 1011, being thereby pressed upon the surface (outward surface) of the conveyer belt 1011. Since voltage is being applied between the conveyer belt 1011 and adhesion roller 1022, the transfer medium P having just been pressed upon the surface of the conveyer belt 1011 remains electrostatically adhered to the surface of the conveyer belt 1011.

5) Regarding the voltage applied between the conveyer belt 1011 and adhesion roller 1022, positive voltage is applied from the adhesion roller 1022 side, and the roller (belt supporting roller) 14, which opposes the adhesion roller 1022, is grounded. The belt supporting roller 14 is longer than the adhesion roller 1022. With the provision of the above described structural arrangement, the transfer medium P remains flatly adhered to the conveyer belt 1011 until it is conveyed to the fourth transfer station, that is, the most downstream transfer station.

6) As described above, as the conveyer belt 1011 is circularly driven, the transfer medium P remaining flatly adhered to the surface of the conveyer belt 1011 is sequentially conveyed through the first to fourth transfer stations different in the development color. While the transfer medium P is conveyed through the first to fourth transfer stations, the toner images on the 1001*a*–1001*d* are sequentially transferred onto the transfer medium P by the electric field (transfer electric field) generated between the photosensitive drums 1001*a*–1001*d*, respectively.

7) After the transfer of the four toner images different in color onto the transfer medium P the transfer medium P becomes separated from the conveyer belt 1011, starting from the leading end thereof, due to the curvature of the roller 1013 (belt driving roller), and is conveyed into the fixing apparatus 100. In the fixing apparatus 100, the transfer medium P is subjected to heat and pressure, so that the four toner images different in color are fixed to the surface of the transfer medium P.

8) After the fixing of the toner images to the transfer medium P, the transfer medium P is discharged by a pair of discharge rollers 1025, with the surface with the images facing downward, onto the delivery tray 1026 located on top of the main assembly 100 of the image forming apparatus.

9) Meanwhile, the residual toner particles, that is, the toner particles remaining on the peripheral surfaces of the photosensitive drums 1001*a*–1001*d* after the toner image transfer, are removed by the cleaning apparatuses 1006*a*–1006*d*, respectively, preparing thereby the photosensitive drums 1001*a*–1001*d* for their following image forming rotation. This concludes the formation of a full-color image formed of four toners having four primary colors, one for one.

(2) Fixing Apparatus 100

Next, the fixing apparatus 100 in this embodiment will be described in detail. The fixing apparatus 100 in this embodiment employs a heating method based on electromagnetic induction.

Figure 2:
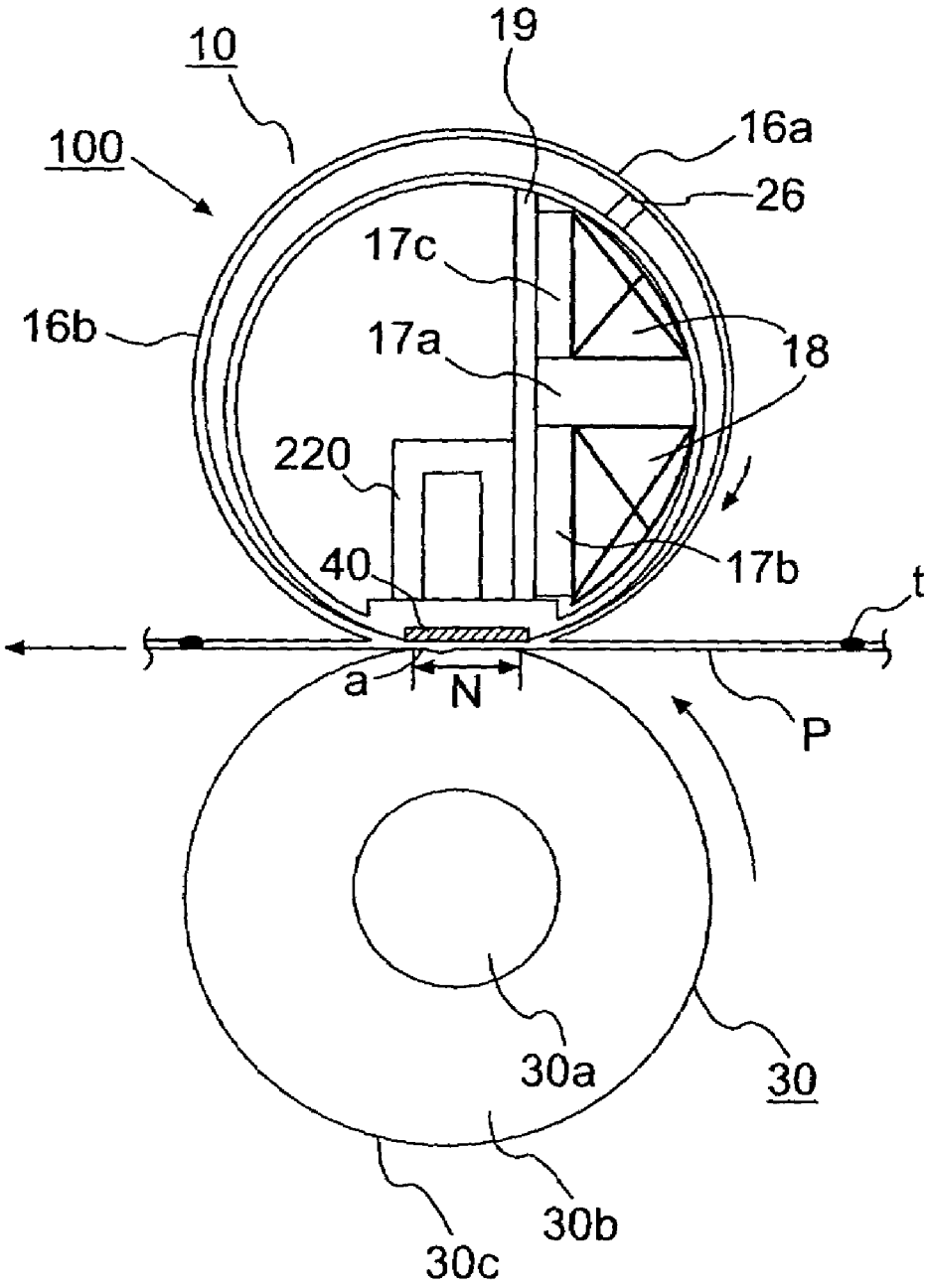
FIG. 2 is a schematic sectional view of the essential portion of the heating apparatus in the first embodiment, perpendicular to the lengthwise direction of the essential portion.
Figure 3:
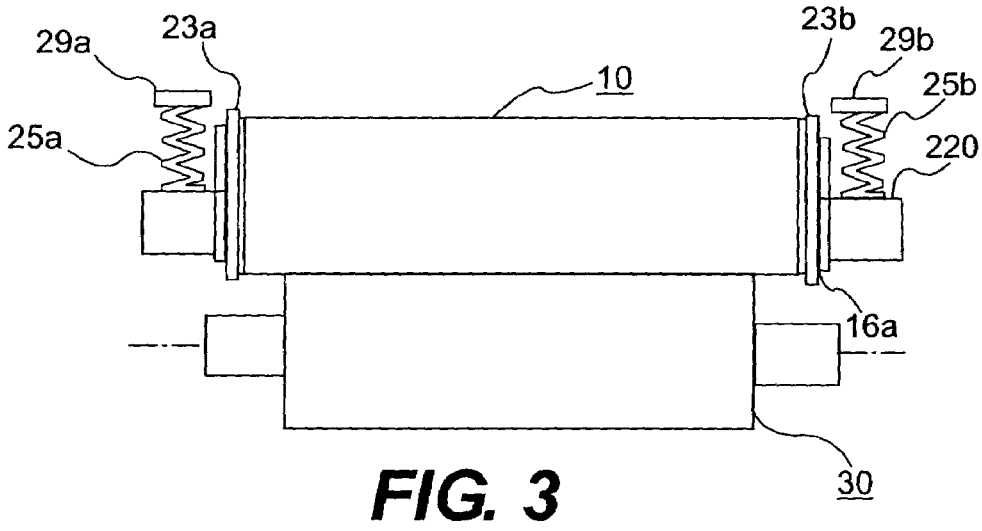
FIG. 3 is a schematic sectional view of the essential portion of the heating apparatus in the first embodiment, parallel to the lengthwise direction of the essential portion.
Figure 4:
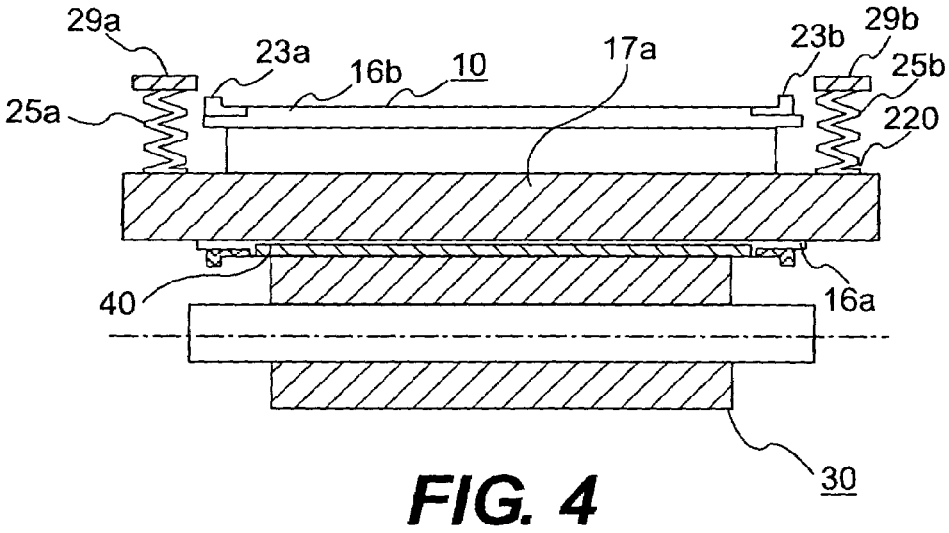
FIG. 4 is a schematic horizontal sectional view of the essential portion of the heating apparatus in the first embodiment.

FIG. 2 is a schematic sectional view of the essential portion of the fixing apparatus 100 in this embodiment, perpendicular to the recording medium conveyance direction, and FIG. 3 is a schematic front view of the essential portion of the fixing apparatus 100 in this embodiment. FIG. 4 is a schematic horizontal sectional view of the essential portion of the fixing apparatus in this embodiment.

The fixing apparatus 100 essentially comprises: a cylindrical film guiding member (member for guiding endless heating member) 16 (having portions 16*a* and 16*b*), as a member for supporting the endless heating member; a cylindrical fixation film 10, as the endless heating member, in which heat can be electromagnetically induced, and which is loosely fitted around the film guiding member 16; and a pressure roller 30 which is kept pressed against the film guiding member 16, to circularly drive the fixation film 10 while forming, and maintaining, a recording medium nipping portion N (which hereinafter will be simply referred to as nip N), with the presence of the fixation film 10 between the film guiding member 16 and the pressure roller 30.

1) Film Guiding Member 16

The film guiding member 16, which is cylindrical, comprises the left and right portions 16*a* and 16*b*, which are semicircular in cross section, and are joined with each other by their open sides. There are magnetic cores 17*a*, 17*b*, and 17*c*, and an excitation coil 18, in the semi-cylinder 16*a* which is on the right side in FIG. 2. The magnetic cores 17*a*, 17*b*, and 17*c* and excitation coil 18 constitute a magnetic field generating means.

2) Pressure Roller 30

The pressure roller (backup member) 30 comprises: a metallic core 30*a*; a heat resistant elastic layer 30*b* molded of such a material as silicone rubber, fluorinated rubber, or fluorinated resin, in the form of a roller, around the metallic core 30*a*, so that its rotational axis coincides with that of the metallic core 30. The peripheral surface of the elastic layer 30*b* may be covered with a mold releasing layer 30*c* (which hereinafter will be simply referred to as release layer 30) formed of PFA, PTFE, FEP, etc. In this embodiment, PPA is used as the material for the release layer 30*c*. The metallic core 30*a* is rotationally supported, by the lengthwise end portions, between the metallic lateral walls of the chassis of the main assembly 100, by the bearings attached to the metallic lateral walls.

The hardness, in Asker-C scale (9.8 N load), of the pressure roller 30 is in the range of 40°–70°. If the hardness of the pressure roller 30 is excessively low, the fixation nip, which forms as the fixation film and pressure roller are pressed against each other, becomes too wide, making it harder for the transfer medium P to be conveyed through the fixation nip. On the other hand, if the hardness of the pressure roller 30 is excessively high, the fixation nip becomes too narrow, adversely affecting fixation.

The film guiding member 16, around which the fixation film 10 is fitted, is disposed on the top side of the pressure roller 30. There is a rigid pressure application stay 220, which extends through the film guiding member 16 from one lengthwise end to the other. Between the lengthwise end portions of the rigid pressure application stay 220, and the spring seats 29*a* and 29*b* of the chassis of the main assembly, the compression springs 25*a* and 25*b* are disposed in the compressed state. Thus, the rigid pressure application stay 220 is kept pressured downward by the force from the pressure application springs 25*a* and 25*b*. As a result, the downwardly facing portion of the peripheral surface of the film guiding member 16 is pressured against the upwardly facing portion of the peripheral surface of the pressure roller 30, forming a fixation nip N with a predetermined width, with the fixation film 10 being pinched between the two surfaces.

The pressure roller 30 is rotationally driven in the counterclockwise direction indicated by an arrow mark by a driving means (unshown). As the pressure roller 30 is rotationally driven, the fixation film 10 is rotationally driven by the friction, which occurs between the peripheral surface of the pressure roller 30 and the outward surface of the fixation film 10, in the fixation nip N. As a result, the fixation film 10 rotates about the film guiding member 16, in the clockwise direction indicated by another arrow mark, at a peripheral velocity virtually the same as that of the pressure roller 30, with the inward surface of the fixation film 10 remaining in contact with the downwardly facing portion of the peripheral surface of the film guiding member 16, in the fixation nip N.

The portion 16*a* of the film guiding member 16, which forms the fixation nip N, is provided with a heat resistant slippery member 40, which is independent from the film guiding member 16*a*.

Instead of providing the film guiding member 16*a* with the slippery member 40, a substance higher in slipperiness may be used as the material for the film guiding member 16*a* so that the peripheral surface of the film guiding member 16*a* itself can provide the same degree of slipperiness as the slippery member 40. In such a case, the film guiding member 16*a* itself is equivalent in slipperiness to the slippery member. The slippery member 40 is desired to be formed of polyimide resin, glass, alumna, glass-coated alumina, or the like. The slippery member 40 in this embodiment comprises a piece of aluminum substrate, and a layer of glass coated on the substrate. The details of the slippery member 40 will be given later.

3) Magnetic Field Generating Means

The magnetic cores 17*a*, 17*b*, and 17*c* which together constitute the magnetic field generating means are desired to be highly permeable. Therefore, such a substance as ferrite, Permalloy, etc., which are used as the material for the core of a transformer, is desirable as the material for the magnetic cores 17*a*, 17*b*, and 17*c*; ferrite, which is small in loss even when the frequency is no less than 100 kHz, is preferable.

The excitation coil 18 which constitutes the magnetic field generating means is formed of multiple pieces of insulated fine copper wire, as electrically conductive wire, which are bundled, and wound multiple times. In this embodiment, the bundled multiple pieces of insulated fine copper wire are wound 12 times.

In consideration of the heat conduction for the fixation film 1, the substance to be used for coating the aforementioned fine copper wire to electrically insulate it, is desired to be heat resistant; the copper wire is desired to be coated with amide-imide or polyimide, for example. In this embodiment, polyimide is used for coating the copper wire, making the coating heat-resistant up to 220° C.

The excitation coil 18 may be compacted inward to increase its wire density.

There is an insulating member 19 between the magnetic field generating means (which comprises magnetic cores 17*a*, 17*b*, and 17*c*, and excitation coil 18), and rigid pressure application stay 220. The material for the insulating member 19 is desired to be superior in insulating properties and heat-resistance. For example, phenol resin, fluorinated resin, polyimide resin, polyamide resin, polyamide-imide resin, polyether-ether-ketone (PEEK) resin, polyether-sulfone (PES) resin, polyphenylene-sulfide (PPS) resin, PFA resin, PTFE resin, FEP resin, LCP resin, etc., are recommendable as the substance to be selected as the material for the insulating member 19.

Figure 5:
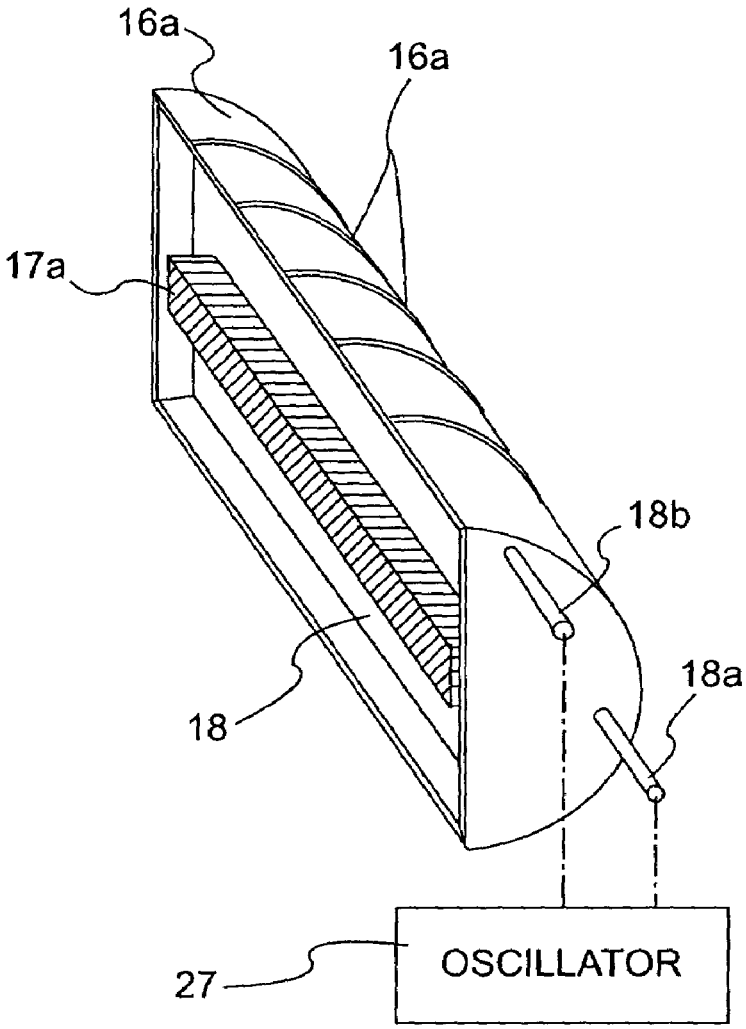
FIG. 5 is a drawing of the magnetic field generating means.

To the power supply terminals 18*a* and 18*b* (FIG. 5) of the excitation coil 18, an excitation circuit 27 is connected. The excitation circuit 27 is configured to produce high frequency (20 kH–500 kHz) with the use of a switching power source. The excitation coil 18 generates alternating magnetic flux, as alternating current (high frequency current) is supplied to the excitation coil from the excitation circuit 27.

The alternating magnetic flux C guided by the magnetic cores 17*a*, 17*b*, and 17*c* induces eddy current in the heat generation layer 1 of the fixation film 10, between the magnetic cores 17*a* and 17*b*, and between the magnetic cores 17*a* and 17*c*. This eddy current generates Joule heat (eddy current loss) in the heat generation layer 1, because of the specific resistance of the heat generation layer 1.

There is a temperature detecting means 26 (FIG. 2), which is disposed on the outward surface of the film guiding member 16, in contact with the inward surface of the fixation film 10. The amount of the electric current supplied to the excitation coil 18 is controlled by an unshown temperature control system, in order to keep the temperature detected by this temperature detecting means, at a predetermined level, so that the temperature of the fixation nip N is maintained at the level suitable for fixation. The temperature detecting means 26 is a temperature sensor such as a thermistor.

4) Fixation Film 10

Figure 6:
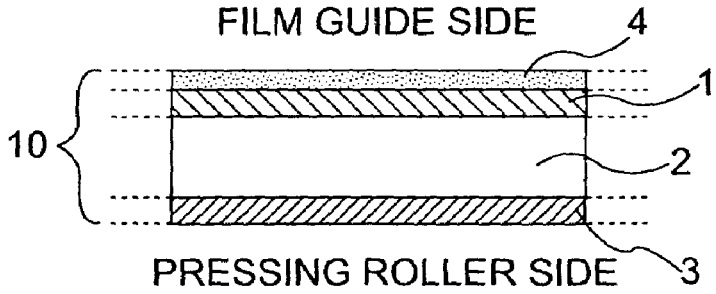
FIG. 6 is a schematic sectional view of the fixing film, which generates heat through electromagnetic induction, showing the structure thereof.

FIG. 6 is a schematic sectional view of the fixation film 10 in this embodiment, showing the structure thereof. The fixation film 10 in this embodiment is multi-layered, comprising: a heat generation layer 1, which also functions as the substrate layer, and formed of a material, such as metallic film, in which heat can be generated by electromagnetic induction; an elastic layer 2 placed on the outward surface of the heat generation layer 1; a release layer 3 placed on the outward surface of the elastic layer 2; and a slippery layer 4 placed on the inward surface of the heat generation layer 1.

In order to bond these layers 1, 2, 3, and 4 to the next layers, a primer layer (unshown) may be placed between the heat generation layer 1 and elastic layer, between the elastic layer 2 and release layer 3, and between the heat generation layer 1 and slippery layer 4.

The fixation film 10 being roughly cylindrical, the slippery layer 4 side is the inward side of the film 10, and the release layer 3 side is the outward side of the film 10.

As described above, as the alternating magnetic flux acts on the heat generation layer 1, eddy current is induced in the heat generation layer 1, generating thereby heat in the heat generation layer 1. Then, the heat is transmitted to the elastic layer 2, and then, to the release layer 3, heating eventually the entirety of the fixation film 10. Consequently, the fixation film 10 heats the recording medium P while the recording medium P is conveyed through the fixation nip N. As a result, the toner images t on the recording medium P are thermally fixed to the recording medium P.

a. Heat Generation Layer 1

As the material for the heat generation layer 1, magnetic metal as well as nonmagnetic metal can be used. However, magnetic metal is preferable. As examples of magnetic metal preferably usable as the material for the heat generation layer 1, there are nickel, iron, ferromagnetic stainless steel, nickel-cobalt alloy, Permalloy, etc. In order to minimize the fatigue of the fixation film 10 caused by the stress generated by the repetitious bending of the fixation film 10 which occurs as the fixation film 10 is circularly driven, manganese may be added to nickel.

The thickness of the heat generation layer 1 is desired to be no less than the value σ, which can be obtained from the following arithmetic formulae (1), and no more than 200 μm. Where the thickness of the heat generation layer 1 is in this range, the heat generation layer 1 can efficiently absorb the electromagnetic waves, being therefore capable of efficiently generating heat.

$$\sigma=(\rho/\pi f\mu)^{1/2} \quad (1)$$

f: frequency [Hz] of excitation circuit;

μ: permeability of heat generation layer 1; and

ρ: specific resistance [Ωm] of heat generation layer 1.

The value ρ represents the depth level to which the electromagnetic waves used for magnetic induction reach into the heat generation layer 1. In other words, at a depth level deeper than the value ρ, the intensity of the electromagnetic waves is no more than 1/e. Inversely stated, by the time the electromagnetic waves reach this depth level, virtually the entirety of the energy of the electromagnetic waves will have been absorbed by the heat generation layer 1.

The thickness of the heat generation layer 1 is preferred to be in the range of 1–100 μm. Where the thickness of the heat generation layer 1 is less than the above range, not all the electromagnetic energy is absorbed, and therefore, the heat generation layer 1 is inferior in efficiency. On the other hand, where the thickness of the heat generation layer 1 is greater than the above range, the heat generation layer 1 is too rigid; it is not flexible enough, in practical terms, to be circularly driven.

b. Elastic Layer 2

As the material for the elastic layer 2, such a substance as silicone rubber, fluorinated rubber, etc., that is heat-resistant and superior in thermal conductivity, are preferably usable.

In order to assure quality in image fixation, the thickness of the elastic layer 2 is desired to be in the range of 10–500 μm. When printing a color image, in particular, a photographic color image, or the like, the recording medium P is solidly covered with toner layers, across various areas substantial in size.

In such a case, if the heating surface (surface of release layer 3) cannot conform in shape to the small peaks and valleys of the recording medium P and/or the toner layer t thereon, the recording medium P and/or toner layer L are nonuniformly heated, creating a difference in glossiness between the area of the recording medium P and/or toner layer t, which is greater in the amount of the heat transmitted thereto, and that which is smaller in the amount of the heat transmitted thereto. More specifically, the areas of the recording medium P and/or toner layer t, which receive a larger amount of heat, become greater in gloss (degree of glossiness) than those which receive a smaller amount of heat. If the thickness of the elastic layer 2 is less than the above described range, the release layer 3 fails to conform in shape to the small peaks and valleys of the surface of the recording medium P and/or toner layer t, resulting in the above described nonuniformity in glossiness. On the other hand, if the thickness of the elastic layer 2 is greater than the above described range, the elastic layer 2 is excessive in thermal resistance, making it difficult for the fixing apparatus to quickly start up. Thus, the thickness of the elastic layer 2 is desired to be in the range of 50–500 μm.

If the elastic layer 2 is excessively hard, it cannot confirm in shape to the small peaks and valleys of the surface of the recording medium P and/or toner layer t, resulting in the above described nonuniformity in the glossiness of an image. Thus, the hardness of the elastic layer 2 is desired to be no more than 60° (JIS-A), preferably, 40° (JIS-A).

The thermal conductivity λ of the elastic layer 2 is desired to be in the range of $2.5\times10^{-1}$–$8.4\times10^{-1}$ W/m·C°, preferably, $3.3\times10^{-1}$–$6.3\times10^{-1}$ W/m·C°. If the thermal conductivity λ is greater than the above range, the elastic layer 2 is too large in thermal resistance, negatively affecting the speed at which the temperature of the fixation film 10 increases at the outward surface of the surface layer (release layer 3). On the other hand, if the thermal conductivity λ is smaller than the above range, the elastic layer 2 is likely to increase in hardness, and/or to sustain permanent compressional deformation.

c. Release Layer 3

As the material for the release layer 3, a substance, such as fluorinated resin, silicone resin, fluorinated silicone rubber, fluorinated rubber, silicone rubber, PFA, PTFE, FEP, etc., which is high in mold releasing properties and heat resistance, is desired.

The thickness of the release layer 3 is desired to be in the range of 1–100 μm. If the thickness of the release layer 3 is set to a value smaller than the above range, there occurs the problem that the release layer 3 becomes nonuniform in thickness as it is coated, becoming inferior in releasing properties and/or durability, across some areas. On the other hand, if the thickness of the release layer 3 is greater than the above range, the release layer 3 is inferior in thermal conductivity. In particular, if a resinous substance is used as the material for the release layer 3 which is greater in thickness than the above range, the release layer 3 will be too hard, adversely affecting the effect of the elastic layer 2.

d. Slippery Layer 4

Referring to FIG. 6, the slippery layer 4 is on the opposite side of the heat generation layer 1 with respect to the elastic layer 2.

As the material for the slippery layer 3, a substance, such a resin as fluorinated resin, polyimide resin, polyamide resin, polyamide-imide resin, PEEK resin, PES resin, PPS resin, PFA resin, PTFE resin, and FEP resin, which is very slippery and heat-resistant, is desirable.

With the provision of the slippery layer 4, not only it is possible to minimize the amount of the torque (measured at rotational shaft of pressure roller as driver roller) necessary to start rotationally driving the fixing apparatus, but also to reduce the amount by which the heat generation 1 of the fixation film 10 wears. In other words, with the provision of the slippery layer 4, it is possible to prevent the problem that the torque necessary to drive the fixing apparatus 100 increases with the increase in the length of the usage of the fixing apparatus 100.

The slippery layer 4 is also heat insulating, interfering with the conduction of the heat generated in the heat generation layer 1, inward of the fixation film 10. Thus, a fixation film with the slippery layer 4 is better than that without the slippery layer 4, in terms of the efficiency with which the heat generated in the heat generation layer 1 is delivered to the recording medium P, being therefore smaller in power consumption.

The thickness of the slippery layer 4 is desired to be in the range of 10–1,000 $\mu$m. If it is no more than 10 $\mu$m, the slippery layer 4 is insufficient in durability, and also, is ineffective to block the heat conduction. On the other hand, if the thickness of the slippery layer 4 exceeds 1,000 $\mu$m, the distances from the magnetic core 17 and excitation coil 18 to the heat generation layer 1 are too large for the magnetic flux to be absorbed by a sufficient amount.

5) Shape of Slippery Member 40

Next, the shape of the slippery member 40, which characterizes this embodiment of the present invention, will be described.

Figure 7A:
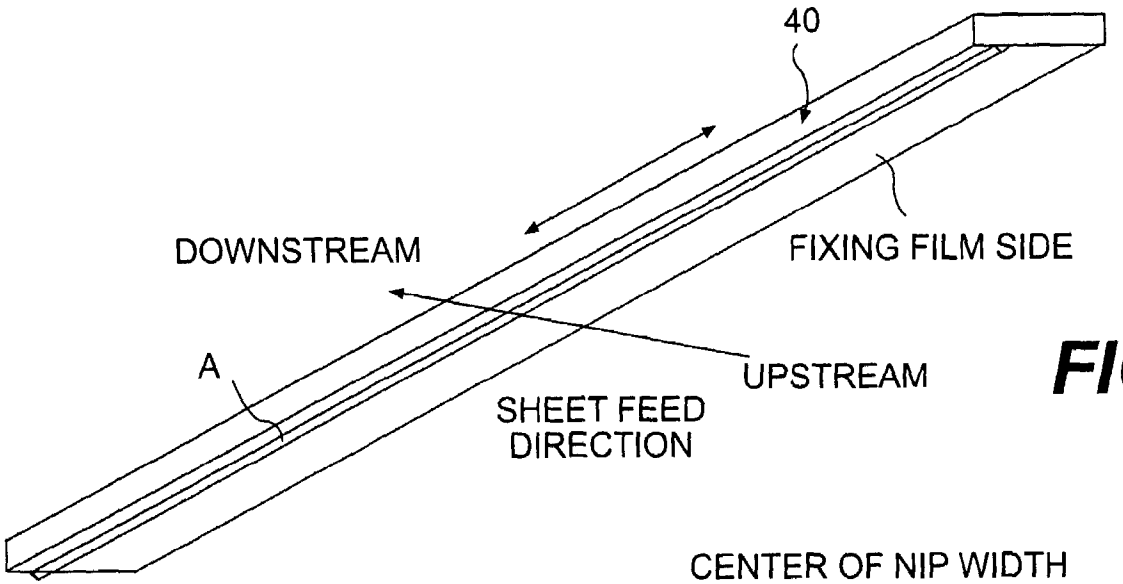
FIG. 7(*a*) is a perspective view of the slippery member in the first embodiment of the present invention, and FIG. 7(*b*) is a cross sectional view.
Figure 7B:
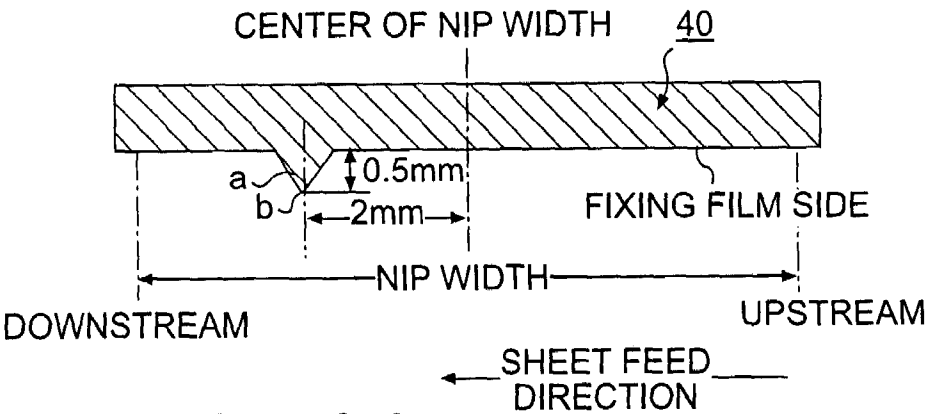
Figure 8A:
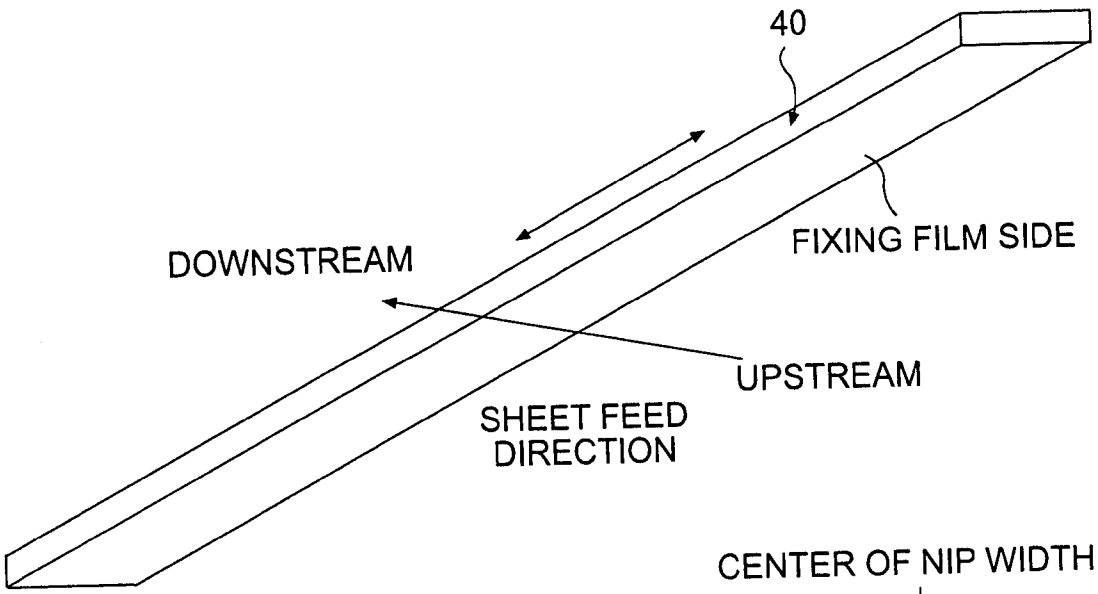
FIG. 8(a) PRIOR ART
FIG. 8(*a*) is a perspective view of the slippery member in accordance with the prior art, and FIG. 8(*b*) is a cross sectional view.
Figure 8B:
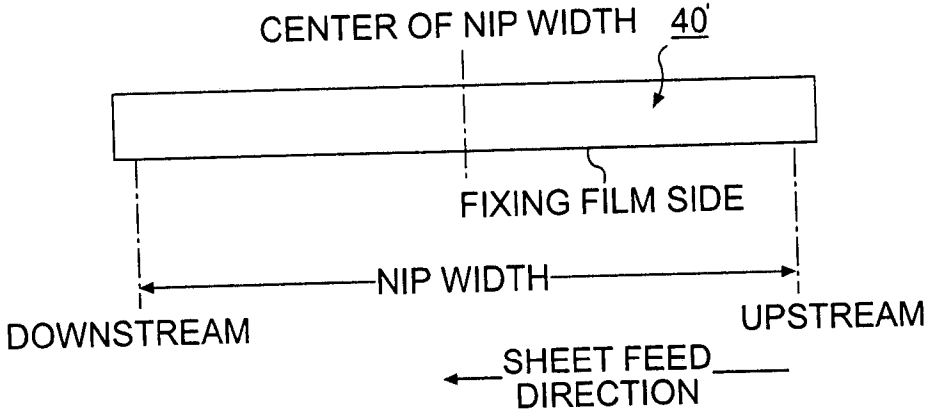
FIG. 8(b) PRIOR ART

The structure of the slippery member 40 in this embodiment is shown in FIG. 7. FIG. 7(*a*) is a perspective view of the slippery member 40, and FIG. 7(*b*) is an enlarged schematic cross sectional view of the slippery member 40, at a plane perpendicular to the lengthwise direction thereof. FIG. 8 shows the structure of the slippery member 40' in accordance with the prior art (which hereinafter will be referred to as conventional slippery member). FIG. 8(*a*) is a perspective view of the slippery member 40', and FIG. 8(*b*) is an enlarged schematic cross sectional view of the slippery member 40', at a plane perpendicular to the lengthwise direction thereof.

The conventional slippery member 40' is flat across the surface which opposes the fixation film, whereas the surface of the slippery member 40 in this embodiment, on which the fixation film slides, is provided with a ridge a which extends in the lengthwise direction of the slippery member 40. The ridge a of the slippery member 40 in this embodiment is triangular in cross section. In terms of the transfer medium conveyance direction, the peak b of the slippery member 40 is positioned 2 mm downstream of the widthwise center of the slippery member 40. The height of the ridge a is 0.5 mm. In this embodiment, in terms of the moving direction of the recording medium, the center of the transfer nip N coincides with that of the slippery member 40. Thus, the ridge a is on the downstream side of the center of the slippery member 40, in terms of the moving direction of the recording medium.

The fixing apparatus 100 was assembled so that the surface of the slippery member 40 having the ridge a faced the fixation film 10. Then, the fixing apparatus 100 was tested for the glossiness of the prints discharged therefrom. The pressure roller 30 of the fixing apparatus 100 was 60° in hardness, and 30 mm in diameter.

Figure 9:
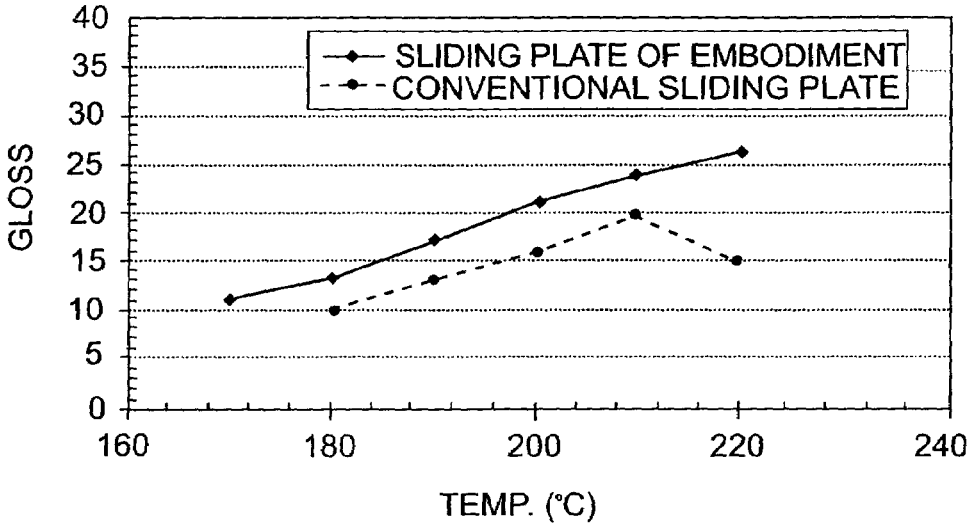
FIG. 9 is a graph showing the difference in glossiness value between the image heating apparatus in accordance with the prior arts, and the image heating apparatus in accordance with the present invention.

FIG. 9 is a graph showing the difference between the glossiness of the print produced with the use of the slippery member 40 in this embodiment, and the glossiness of the print produced with the use of the conventional slippery member 40'.

Incidentally, the glossiness values given in the graph are the values obtained when the glossiness of the prints were measured with the use of a Glossmeter (PG-3D), a product of Nippon Denshoku Co., Ltd., at an incident angle of 70°. As is evident from FIG. 9, as long as the conventional slippery member 40' and the slippery member 40 in this embodiment were equal in fixation temperature, the latter was higher in the glossiness of a print.

Further, in the case of the conventional slippery member 40', when the fixation temperature was higher than a certain level, "hot offsets" occurred, reducing the level of glossiness at which prints were produced.

In the case of the slippery member 40 in this embodiment, however, the glossiness level did not lower, in spite of the increase in the fixation temperature; more concretely, the glossiness level did not lower when the slippery member 40 was operated at a fixation temperature much higher than that at which the conventional slippery member 40' was operated. This proved that the slippery member 40 in this embodiment was wider in the fixation temperature range in which "hot offset" did not occur.

Figure 10:
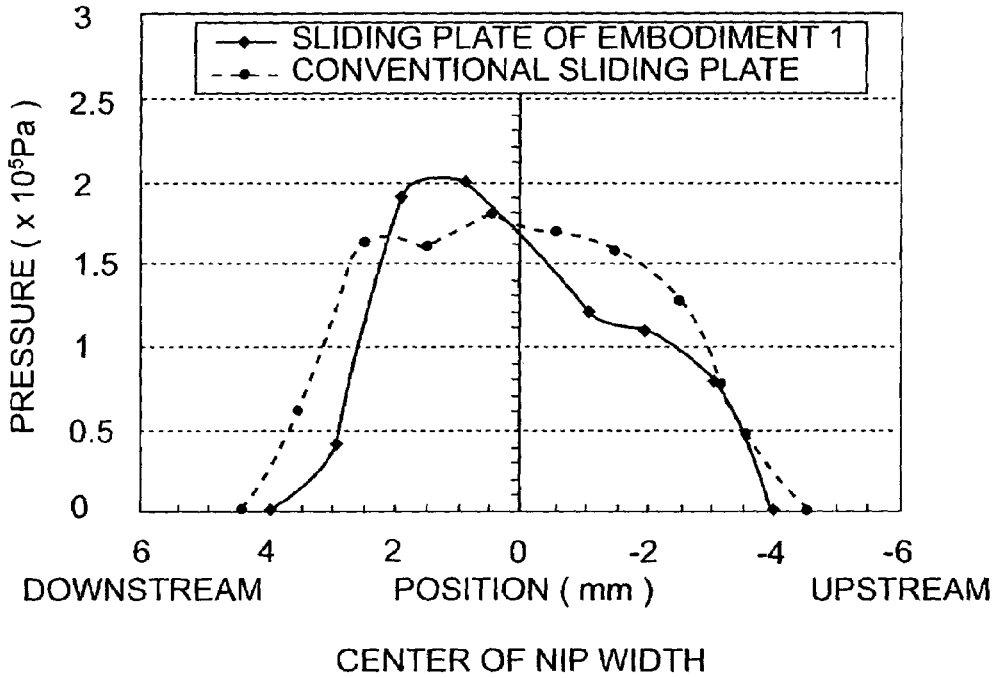
FIG. 10 is a graph showing the difference in the pressure distribution in the fixation nip between the image heating apparatus in accordance with the prior arts, and the image heating apparatus in accordance with the present invention.

FIG. 10 shows the difference, in the pressure distribution in the fixation nip N, between when the conventional slippery member 40' was employed, and when the slippery member 40 in this embodiment was employed. As is evident from FIG. 10, in the case of the conventional slippery member 40', the pressure roller 30 was flattened by the slippery member 40 across its contact area, effecting thereby a flat fixation nip. In the case of the slippery member 40 in this embodiment, however, the pressure roller 30 effected a fixation nip which is not flat, because it conformed in shape to the surface of the slippery member 40 provided with the ridge a. As a result, the peak of the pressure distribution deviated downstream in terms of the recording medium conveyance direction.

With the peak of the pressure distribution in the fixation nip N being on the downstream side of the center of the fixation nip N, fixation pressure was applied after the toner had melted more than when the conventional slippery member 40' was employed. As a result, the resultant prints were higher in glossiness. Further, the ridge a presses on the toner image bearing surface of the transfer medium, facilitating the pressure conduction.

Also in the case of the slippery member 40 in this embodiment, the rate at which the fixation pressure applied to the recording medium and toner layer decreases as the recording medium comes out of the fixation nip N is greater than the rate at which the fixation pressure applied to the recording medium and toner layer increases as the recording medium enters the fixation nip N. In other words, the distance from the upstream edge of the nip N to the point of the nip N with the highest fixation pressure is longer, causing the fixation pressure to more gradually peak, than in the case of the conventional slippery member 40'. Therefore, fixation pressure is more uniformly applied to the toner images having been layered on the transfer medium. In addition, the ridge for providing the pressure peak is placed on the slippery member, which contacts the inward surface of the "fixation film which contacts the toner images". In other words, the ridge is located so that it faces the front surface, that is, the toner image bearing surface, of the recording medium, rather than the back surface. Therefore, the ridge can create the pressure peak effective for better fixing the toner images, although it is minuscule enough in height not to interfere with the circular driving of the fixation film. Further, the application of heat and pressure to the toner layer t on the transfer medium P is virtually instantly stops, making it difficult for "hot offset" to occur, and therefore, widening the temperature range in which "hot offset" does not occur. Therefore, the employment of the slippery member 40 in this embodiment makes it possible to set the fixation temperature higher, raising the glossiness level at which the toner layer is fixed, compared to when the conventional slippery member 40' is employed.

As described above, the slippery member 40 in this embodiment can increase the absolute value of the glossiness level at which the toner layer is fixed. Further, it can widen the fixation temperature range; in other words, it can raises the level of the glossiness at which the toner layer is fixed.

Further, in the case of the slippery member 40 in this embodiment, the point at which the pressure applied by the pressure roller 30 is highest is on the downstream side of the center of the fixation nip N; in other words, the pressure peak occurs after the toner layer has further melted than when the conventional slippery member 40' is in use. Therefore, toner images are better fixed than when the conventional slippery member 40' is in use.

Embodiment 2

The image forming apparatus in this embodiment is basically the same in structure as the image forming apparatus in the first embodiment, and therefore, the structure of this image forming apparatus will not be described here. Further, the fixing apparatus 100 in this embodiment employs the same heat generating method, that is, the method which generates heat through electromagnetic induction.

Figure 11:
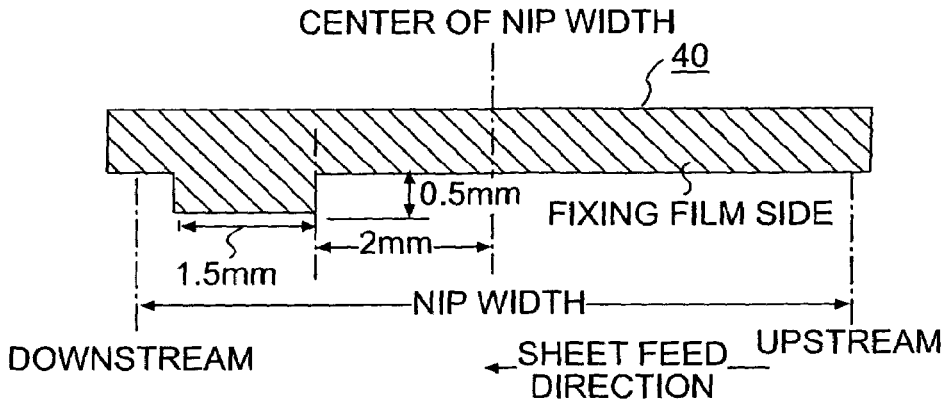
FIG. 11 is a schematic sectional view of the slippery member in the second embodiment of the present invention.

Also in this embodiment, the slippery member is provided with a ridge, which extends in the lengthwise direction of the slippery member. The ridge in this embodiment, however, is different in shape from that in the first embodiment, being flat across the top. FIG. 11 is a cross sectional view of the slippery member in this embodiment. The cross section of the ridge in this embodiment is rectangular, being 0.5 mm in height and 1.5 mm in width. The ridge is on the downstream side of the widthwise center of the fixation nip, in terms of the recording medium conveyance direction, and the distance from the widthwise center of the fixation nip to the upstream edge of the ridge is 2 mm.

Figure 12:
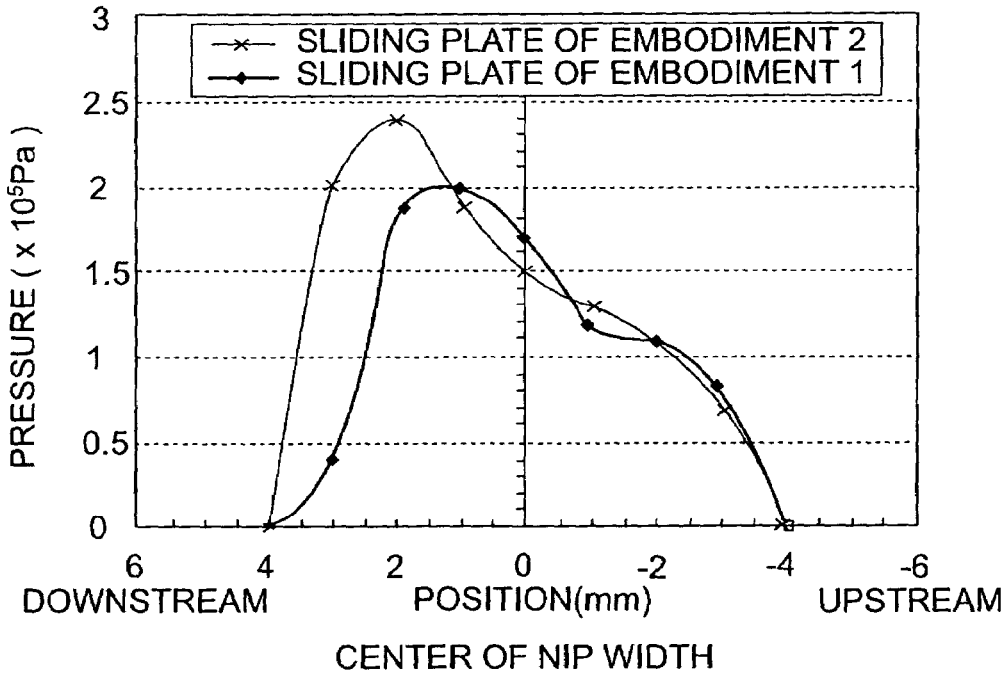
FIG. 12 is a graph showing the difference in the pressure distribution in the fixing nip between the second and first embodiments.

FIG. 12 shows the difference, in the pressure distribution in the fixation nip N, between when the slippery member in the first embodiment was employed, and when the slippery member in this embodiment was employed. As is evident from FIG. 12, not only does the employment of the slippery member in this embodiment shift the pressure peak further downstream, by the distance proportional to the increase in the size of the top of the ridge, relative to the point of the pressure peak which occurs with the employment of the slippery member in the first embodiment, but also, it increases peak pressure and widens the nip in terms of the transfer medium conveyance direction.

Thus, this embodiment of the present invention can further improve the fixing apparatus in terms of the level of glossiness, as well as the level of fastness, at which the toner layer is fixed.

Embodiment 3

The image forming apparatus in this embodiment is basically the same in structure as the image forming apparatus in the first embodiment, and therefore, the structure of this image forming apparatus will not be described here. In this embodiment, a fixing apparatus of a film heating type is employed. First, therefore, a fixing apparatus of a film heating type will be described in detail.

Figure 13:
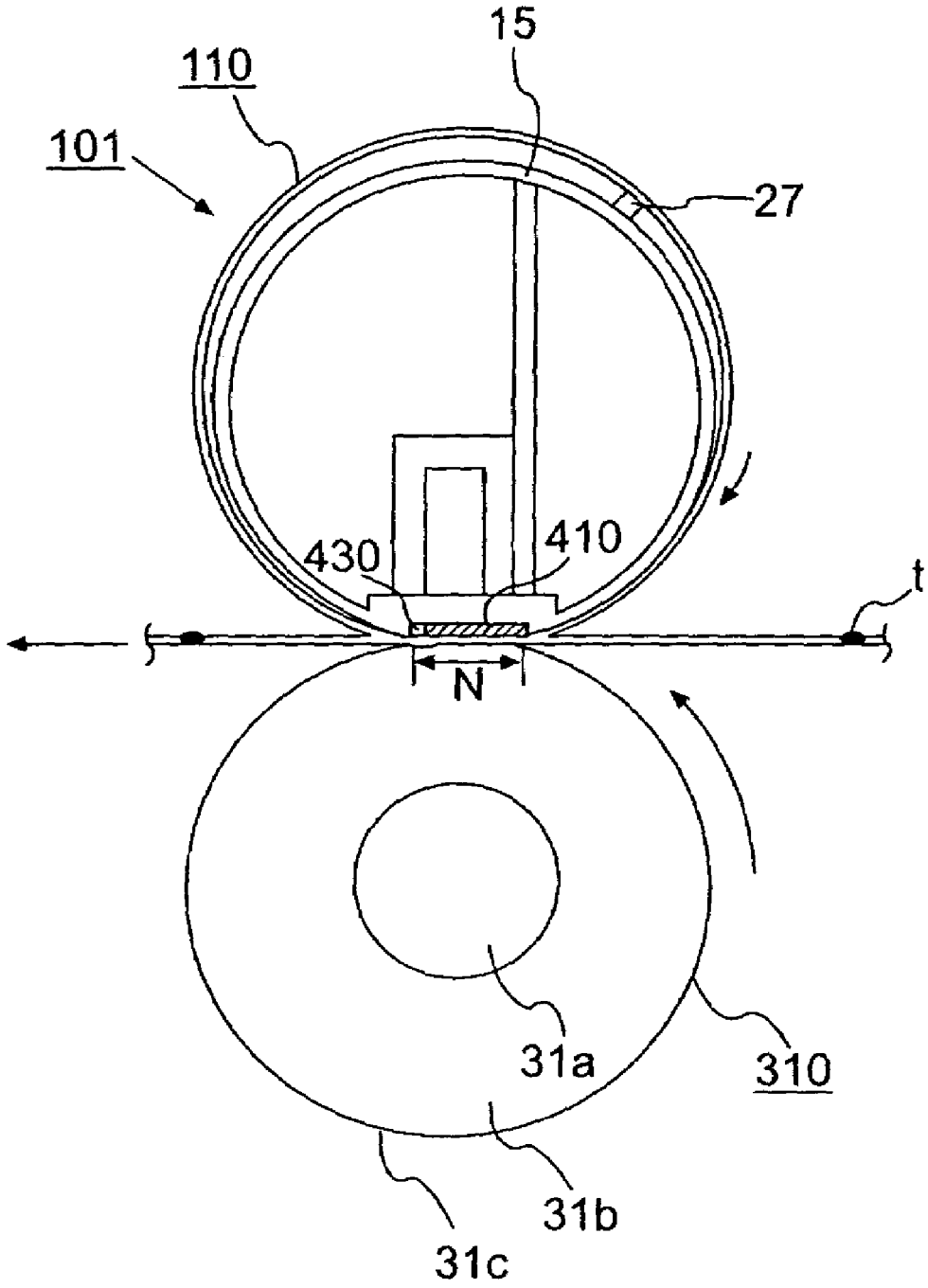
FIG. 13 is a schematic sectional view of the essential portion of the heating apparatus in the third embodiment, perpendicular to the lengthwise direction of the essential portion.

FIG. 13 is a sectional view of the fixing apparatus in the third embodiment of the present invention. This fixing apparatus 101 comprises a fixation heater, a heater holder, a thermistor, a fixation film, a pressure roller, an entrance guide, etc.

The fixation heater 410 comprises: an aluminum substrate; a heat generating resistor formed on the substrate by coating electrically conductive paste, which contains silver-palladium alloy, on the substrate, to a uniform thickness, with the use of a screen printing method; and a glass coat formed on the heat generating resistor, of pressure resistant glass.

The heater holder 15 is formed of highly heat-resistant liquid polymer resin, and plays the roles of holding the fixation heater and guiding the fixation film.

The fixation film is made up of a cylindrical endless film, which is formed of polyimide resin and 50 $\mu$m in thickness; a silicone rubber layer formed on the endless film by ring-coating method; and a PFA resin tube which is 30 $\mu$m in thickness and covers the silicone rubber layer. From the standpoint of raising the temperature of the fixation film 110 it is desired that a substance which is highly electrically conductive is employed as the material for the silicone rubber layer, in order to reduce the thermal capacity of the fixation film 110.

In this embodiment, a silicone rubber having a thermal conductivity of roughly $4\times10^{-1}$ W/m·°C., which is relatively high for silicone rubber, is used as the material for the fixation film 110.

The silicone rubber layer in this embodiment is 250 $\mu$m in thickness. Further, its surface is covered with a uniform layer of fluorinated resin, to make the surface of the fixation film 110 better in mold releasing properties. The surface of the fixation film 110 can be easily covered with a layer of fluorinated resin, by forming the fluorinated resin as the material for fluorinated resin layer, into a tube.

The pressure roller 310 comprises: a metallic core 31*a* formed of stainless steel; an approximately 3 mm thick silicone rubber layer 31*b* formed around the metallic core by injection molding; and a piece of approximately 40 $\mu$m thick PFA resin tube 31*c* fitted over the silicone rubber layer.

In the case of the fixing apparatus in this embodiment, the fixation film 110 is circularly rotated by the rotation of the pressure roller 310, with the fixing film 11 sliding on the heater holder 15 by the inward surface. The inward surface of the fixation film 110 is coated with grease, assuring that the fixation film 110 easily slides on the heater holder 15 by the inward surface.

The film guide 15 is provided with a temperature detecting means 27 (FIG. 13), which is place don the outward surface of the film guide 15, in contact with the inward surface of the fixation film 11. The current supply to the heater 410 is controlled by an unshown temperature control circuit so that the temperature detected by this temperature detecting means 27 remains at a predetermined level; it is controlled so that the temperature in the fixation nip N remains at a proper level for fixation. The temperature detecting means 27 is a temperature sensor such as a thermistor.

Figure 14:
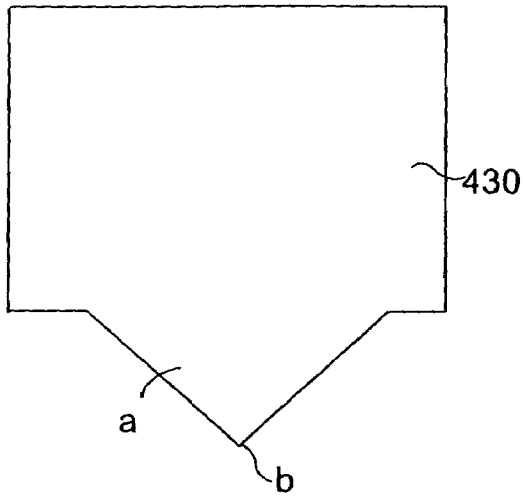
FIG. 14 is an enlarged sectional view of the member with a projection, in the third embodiment, perpendicular to the lengthwise direction of the essential portion.

In this embodiment, the fixation heater is provided with a member 430 with ridge (ridge providing member), which is on the downstream side of the heater and extends in the lengthwise direction of the heater. FIG. 14 is an enlarged cross sectional view of the ridge providing member 430. The ridge a of the ridge providing member in this embodiment is triangular in cross section.

Figure 15:
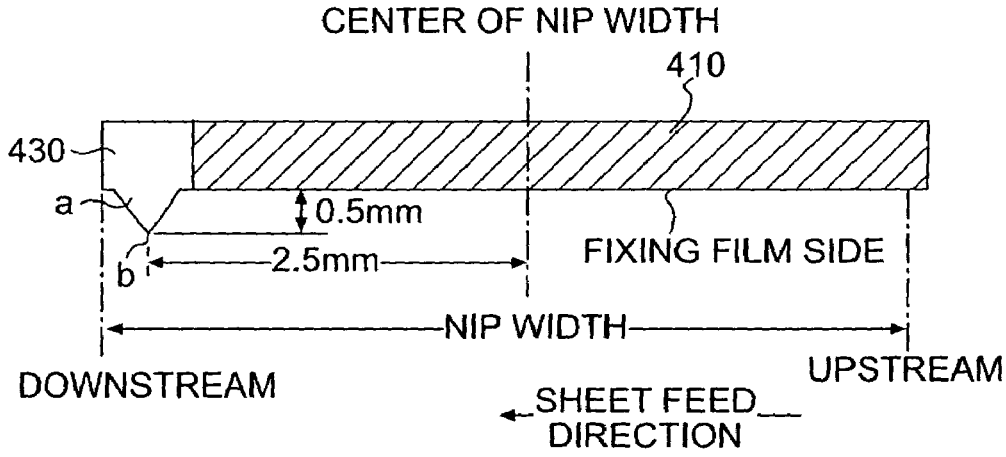
FIG. 15 is an enlarged schematic sectional view of the essential portion of the heating apparatus in the third embodiment, perpendicular to the lengthwise direction of the essential portion.

FIG. 15 is an enlarged sectional view of the fixation nip N and its adjacencies. As shown in FIG. 15, in terms of the transfer medium conveyance direction, the peak b of the ridge providing member is positioned 2.5 mm downstream of the widthwise center of the nip. The height of the peak b of the ridge a is 0.5 mm.

The ridge providing member 430 and heater are structured so that the ridge providing member 430 is to be attached to the downstream end of the heater, and that the ridge a of the ridge providing member 430 will be within the range of the fixation film 11 in terms of the transfer medium conveyance direction.

With the employment of the above described structural arrangement, not only is it possible to provide the same effects as those provided by the first embodiment, but also, it is assured by the presence of the fixation heater 410 as a heat generating member, that a transfer nip capable of efficiently transmitting heat is formed.

Next, additional embodiments of the present invention will be described.

Embodiment 4

Figure 18:
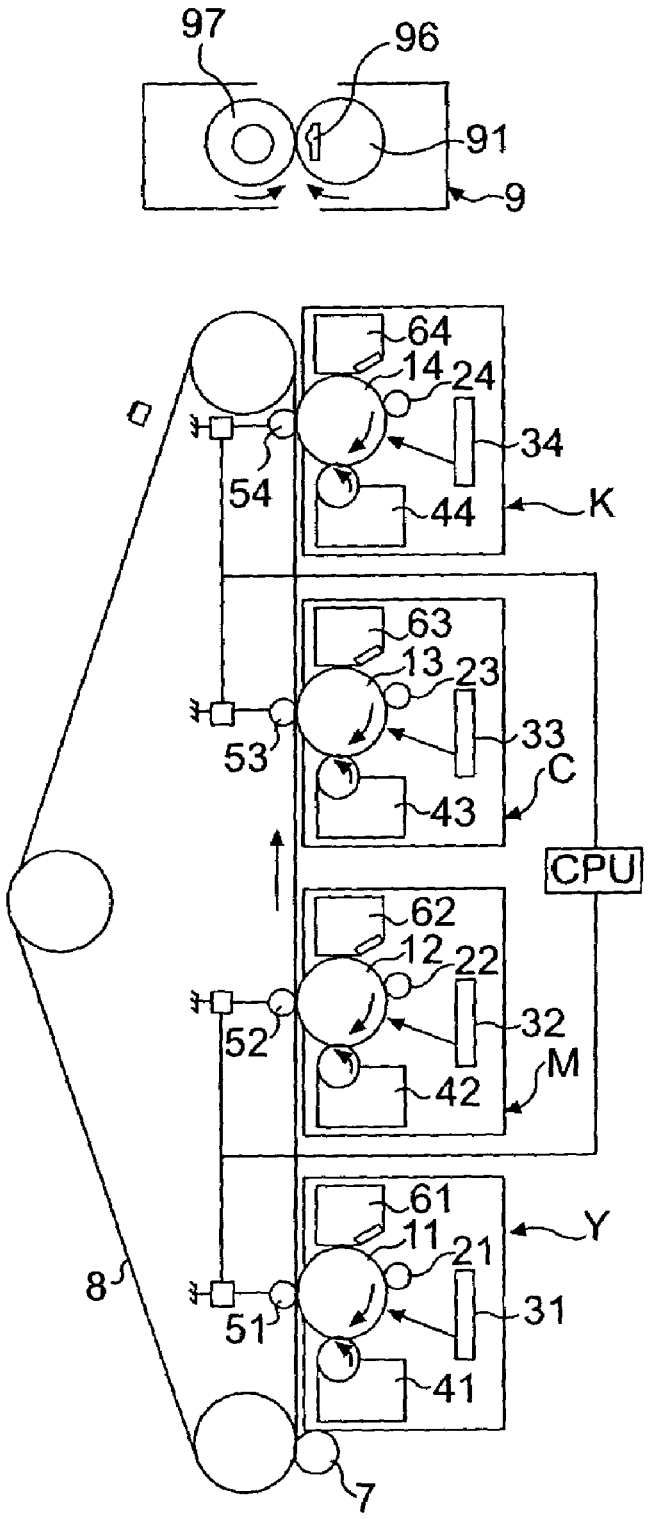
FIG. 18 is a schematic sectional view of an image forming apparatus equipped with the fixing apparatus in the fourth embodiment of the present invention.

FIG. 18 is a schematic sectional view of a color image forming apparatus employing an electrophotographic process. This color image forming apparatus has four color stations (image formation stations): Y (yellow), M (magenta), C (cyan), and K (black) color stations, which are independent from each other, and each comprise: a photosensitive drum, a developing apparatus, and a cleaning apparatus. The four color stations are vertically aligned. A full-color image is obtained by transferring four toner images different in color onto a recording medium, as the recording medium is conveyed through the four color stations, while being adhered to an electrostatic transfer belt.

Referring to FIG. 18, designated by referential numbers 11–14 are electrophotographic photosensitive members (which hereinafter will be referred to as photosensitive drums) in the form of a rotatable drum, which are repeatedly used as image bearing members. They are rotationally driven in the counterclockwise direction indicated by arrow marks, at a predetermined peripheral speed (process speed).

Each photosensitive drum is a negatively chargeable photosensitive member (organic photoconductive drum) with a diameter of 30 mm. The process speed of the image forming apparatus in this embodiment is 94 mm/sec.

As the photosensitive drums are rotated, they are uniformly charged by primary charge rollers 21–24 as charging apparatuses to predetermined polarity and potential level, and their charged portions are exposed by exposing apparatuses 31–34 (comprising: a laser diode; a polygon scanner; a lens group; etc.). As a result, electrostatic latent images corresponding to color components (yellow, magenta, cyan, and black, for example) of an intended image are formed.

Each charging apparatus employs a contact type charging method. Thus, the charge roller of the charging apparatus, which is $1\times10^6$ Ω in actually measured electrical resistance, is placed in contact with the peripheral surface of the photosensitive drum, so that a total contact pressure of 9.8 N is maintained between the peripheral surfaces of the charge roller and photosensitive drum. Then, as a DC voltage of −1.2 kV is applied to the charge roller, the peripheral surface of the photosensitive drum is charged to −600 V. Incidentally, the charge roller is rotated by the rotation of the photosensitive drum. The exposing means in this embodiment is a polygon scanner employing a laser diode. It focuses a laser beam on the peripheral surface of the photosensitive drum, while modulating the beam with image formation signals, forming an electrophotographic latent image on the peripheral surface of the photosensitive drum.

In order to assure that the point on the peripheral surface of one of photosensitive members, at which a latent image begins to be written, in the corresponding color station, always aligns with the point on a recording medium, with which the point on the peripheral surface of another photosensitive member, at which a latent image begins to be written, aligns, the beam of exposure light is oscillated in the following manner. That is, in terms of the primary scanning direction (direction perpendicular to recording medium advancement direction), each exposing apparatus is made to begin projecting the beam of exposure light a predetermined length of time after the reception of a position signal, called BD, from the polygon scanner, and in terms of the secondary scanning direction (direction parallel to recording medium conveyance direction), the exposing apparatus is made to begin projecting the beam of exposure light a predetermined length of time after the reception of the TOP signal generated by a switch in the recording medium conveyance path.

The electrostatic latent images are developed by the developing apparatuses in the corresponding color stations, respectively. The development roller of each of the developing apparatuses 41–44 (for yellow, magenta, cyan, and black color components) is rotated by an unshown apparatus for rotationally driving the development roller, in the directions indicated by the arrow marks in the drawing. Each developing apparatus is disposed so that the distance between its development roller and the corresponding photosensitive drum becomes smallest in the development station.

The toner particles of the toners Y, M, C, and K in this embodiment do not contain magnetic substances. In other words, the toners Y, M, C, and K are so-called nonmagnetic toners. Thus, an electrostatic latent image is developed using a jumping developing method (noncontact type single-component developing method).

The developing apparatuses 41–44 each comprise an aluminum development sleeve and a development blade. The development sleeve is 16 mm in diameter and is disposed virtually in contact with the photosensitive drum, with the presence of a gap of 250 μm between the peripheral surfaces of the development sleeve and photosensitive drum. The development blade is a piece of thin metallic plate coated with nylon. In operation, an AC voltage which is rectangular in waveform, 1 kHz in frequency, and 1,600 V in peak-to-peak voltage is applied to the development sleeve which is being rotationally driven at the same peripheral velocity as the photosensitive drum, causing thereby toner particles to jump between the development sleeve and photosensitive drum in order to develop the electrostatic latent image on the photosensitive drum.

The toners are produced by polymerization, and their particles are spherical. Further, each particle has two layers: a core formed of wax, and a resinous binder layer called shell. Their MI (melt index) are 30, which is relatively high and is realized by optimizing the cross-linking condition during production. The higher the MI of a toner, the lower in viscosity the toner in the melted condition.

The aforementioned value (30) of the MIs of the toners, is such a value obtained by measuring the MIs of the toners, using the method defined by the JIS, at 135° C. while applying a load of 2 kg.

Usage of a toner which is high in the MI makes it possible to realize a high level of glossiness.

Incidentally, the referential numbers 61–64 in FIG. 18 designate cleaning apparatuses, which are for removing the toner particles remaining on the photosensitive drum after transfer.

The transfer belt 8 as a recording medium bearing member for bearing and conveying the recording medium is circularly driven in the direction indicated by an arrow mark at the same peripheral velocity as each photosensitive drum.

The transfer belt 8 is a single-layer belt formed of resin (PVDF). It is 100 $\mu$m in thickness, and its electrical resistance has been adjusted to $1\times10^{11}$ Ω·cm. It is prevented from snaking and/or laterally deviating, by a pair of ribs bonded on the inward surface of the transfer belt 8, along the lateral edges.

As the transferring member for transferring the toner images on the photosensitive drums onto a recording medium, transfer rollers 51–54 formed of epichlorohydrin rubber, the volume resistivity of which has been adjusted to $1\times10^{7}$ Ω·cm, and which is capable of withstanding high voltage, is used. The transfer rollers 51–54 are kept pressed on the corresponding photosensitive drums from behind the transfer belt.

After being fed out of a cassette, a recording medium is conveyed between a pair of registration rollers, and then, comes into contact with the transfer belt 8 while being guided by a transfer station entrance guide.

In this embodiment, in order to minimize the vertically projected area of an image forming apparatus, and/or to make it possible to exchange a cartridge, or deal with a paper jam, simply by opening the front door, the cartridges (aforementioned operational stations) are vertically aligned, dividing thereby the main assembly of the image forming apparatus into two sides: the transfer belt side and cartridge side.

With the provision of the above described structural arrangement, a recording medium is conveyed upward against gravity, making it necessary for the recording medium to remain firmly adhered to the transfer belt.

There is an adhesion roller 7 in the adjacencies of the point at which a recording medium comes into contact with the transfer belt 8. During an image forming operation, a voltage of +1 kV is applied to the adhesion roller 7 to give the recording medium, for example, a sheet of paper, electrical charge, in order to keep the recording medium firmly adhered to the conveyer belt.

The adhesion roller 7 is a solid rubber roller with a diameter of 12 mm. It is formed of EPDM rubber in which carbon black has been dispersed for electric resistance adjustment. It is structured so that high voltage can be applied, as the adhesion bias, to the metallic core thereof. The electric resistance value of the adhesion roller 7, which in this embodiment is such a resistance value that is obtained when 500 V is applied between the piece of 1 cm wide metallic foil wrapped around the peripheral surface of the adhesion roller 7 and the metallic core of the adhesion roller 7, has been adjusted to $1\times10^{6}$ Ω·cm.

After the recording medium is fed out of the unshown cassette, conveyed through the transfer station entrance guide, and given the electric charge, which keeps the recording medium adhered to the transfer belt 8 by the adhesion roller 7, as it passes by the adhesion roller 7, it enters the transfer station for the first color component. In the transfer station, the toner image on the photosensitive drum for the first color component is transferred onto the recording medium, by the transfer roller on the inward side of the transfer belt. The magnitude of the bias to be applied to the transfer roller is calculated based on the impedances of the transfer belt and recording medium calculated based on the electric current which flows to the adhesion roller while the recording medium (paper) is conveyed through the transfer station. In the case of the single-sided print mode carried out in the normal condition, a DC voltage of roughly +1.5 kV is applied to each transfer station from a high voltage power source.

Each time the recording medium is conveyed through one of the color stations, a toner image different in color from the toner image or images, which have, or will, be transferred onto the recording medium, is transferred onto the recording medium, resulting in the formation of a full-color image on the recording medium.

After the completion of the transfer of all the toner images different in color, the recording medium is separated from the transfer belt by the curvature of the transfer belt, which occurs at the downstream end of the range in which the transfer belt is circularly driven. Then, the toner images on the recording medium are fixed in a fixing apparatus 9, and then, the recording medium is discharged as a finished print from the main assembly of the image forming apparatus.

Figure 20:
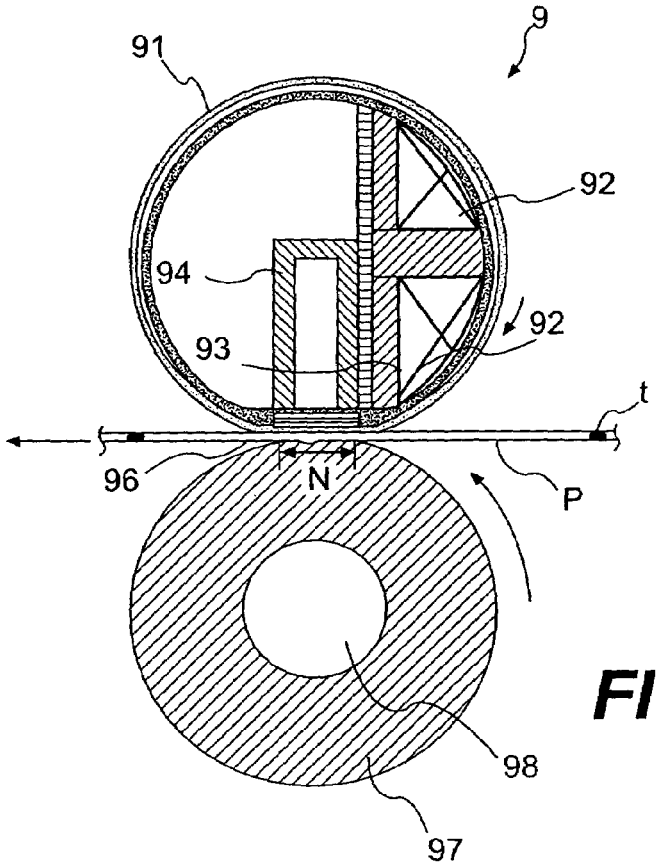
FIG. 20 is a schematic sectional view of the fixing apparatus in the fourth embodiment of the present invention.

In this embodiment, an on-demand type fixing apparatus, such as the one shown in FIG. 20, which employs a heating method based on electromagnetic induction, is employed. The fixing apparatus comprises: an electrocasted 50 $\mu$m thick nickel sleeve; a heat generation sleeve 91 with a diameter of 34 mm, an induction coil 92; an excitation core (ferrite core) 93 for providing magnetism path; a plastic core holder 95 (which also functions as sleeve guide) which holds in its hollow the induction coil 92 and excitation core 93; a slippery plate 96; a pressure application stay 94 for backing the slippery plate 96; and a pressure roller 97, as a recording medium pressing member, with a diameter of 30 mm. The heat generation sleeve 91 comprises: a 250 $\mu$m thick elastic layer formed of silicone rubber, and a 50 $\mu$m thick PFA layer (in the form of a tube), as a release layer, laminated to the elastic layer.

Incidentally, the aforementioned on-demand type fixing apparatus means a fixing apparatus capable of starting up in temperature from 25° C. to 150° C. within 30 seconds, in other words, a fixing apparatus capable of carrying out an actual fixing process on demand.

During fixation, high frequency current is flowed through the coil 92, inducing thereby eddy current in the nickel layer of the sleeve 91. This eddy current causes the nickel layer to generate heat. The temperature of the fixation nip N is controlled by controlling the amount of the high frequency current flowed to the coil 92, based on the temperature detected by an unshown thermistor placed in contact with the inward surface of the sleeve 91. The toner images on the recording medium P are fixed to the recording medium P with heat and pressure, by conveying the recording medium P, along with the unfixed toner t on the recording medium P, through the fixation nip N formed between the fixation roller 91 and pressure roller 97.

The fixing apparatus is driven by rotationally driving the metallic core 98 of the pressure roller 97, and the sleeve 91 is driven by the friction between the sleeve 91 and the peripheral surface of the pressure roller 97.

Next, the structural configuration for the fixing apparatus, which makes the pressure within the fixation nip N highest, on the downstream side of the center of the fixation nip, in terms of the recording medium advancement direction, will be described.

Figure 17:
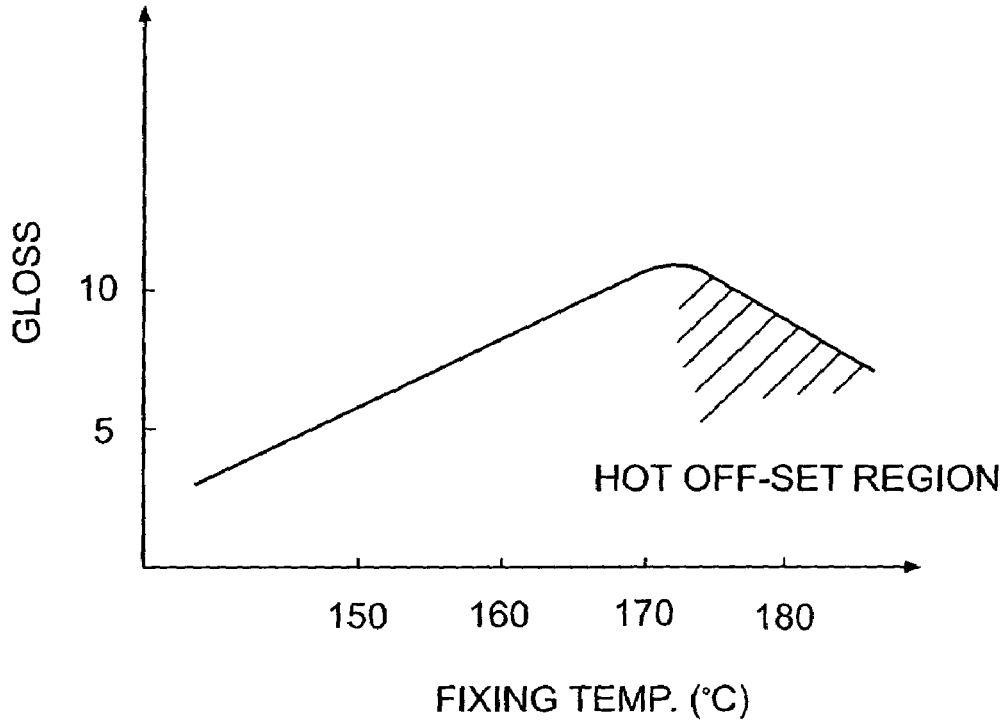
FIG. 17 PRIOR ART
FIG. 17 is a graph showing the concept of glossiness level curve in accordance with the prior art.

As described before, a high level of glossiness can be achieved by using a toner with a high MI, which can be fixed at a higher temperature. Referring to FIG. 17, however, as the fixation temperature increases past a certain temperature, the glossiness declines. This occurs because the higher the fixation temperature past a certain temperature, the more the amount by which the toner on a recording medium is peeled away ("hot offset") by the fixation roller (fixation sleeve), and therefore, the lower the level of glossiness.

Figure 16A:
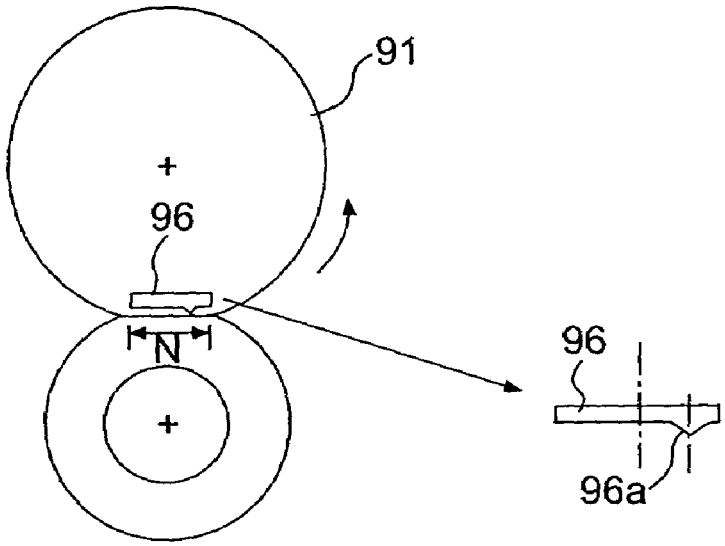
FIGS. 16(*a*) and 16(*b*) are schematic sectional views of the essential portions of the fixing apparatuses in the fourth and sixth embodiments.
Figure 16B:
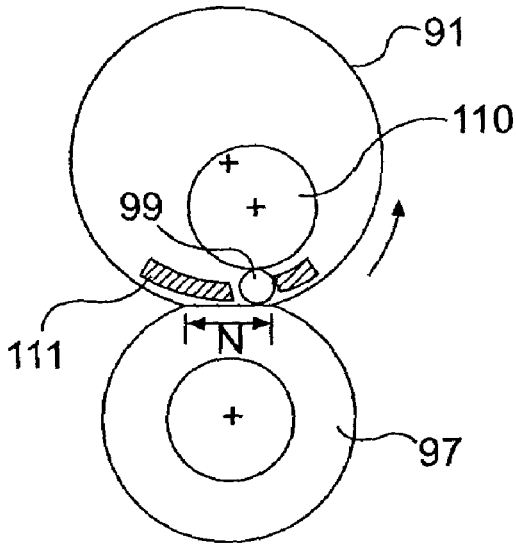

Referring to FIGS. 16(*a*) and 19(*a*), in this embodiment, the slippery plate 96 is provided with a ridge 96*a*, which is on the downstream side of the slippery plate 96, to increase the internal pressure of the fixation nip N, at the location of the ridge 96*a*. The ridge 96*a* is 0.5 mm in height, and 1 mm in width in terms of the recording medium conveyance direction. The slippery plate 96 is positioned so that the position of the tip of the ridge 96*a* becomes 3 mm downstream of the center of the fixation nip N in terms of the recording medium advancement direction. The slippery plate 96 is a piece of metallic plate, which in this embodiment is a piece of SUS 304 plate, coated with polyimide. The pressure roller of the fixing apparatus in this embodiment is formed of silicone rubber, and is 30 mm in diameter. Its hardness in the finished condition is 60 degrees. It is kept pressed against the above described slippery plate 96 with the application of a total pressure of 196.14 N (20 kgf), creating the fixation nip N with a width of 8 mm (in terms of recording medium advancement direction). The distribution of the internal pressure of the fixation nip N is as shown in FIG. 19(*b*).

Figure 19A:
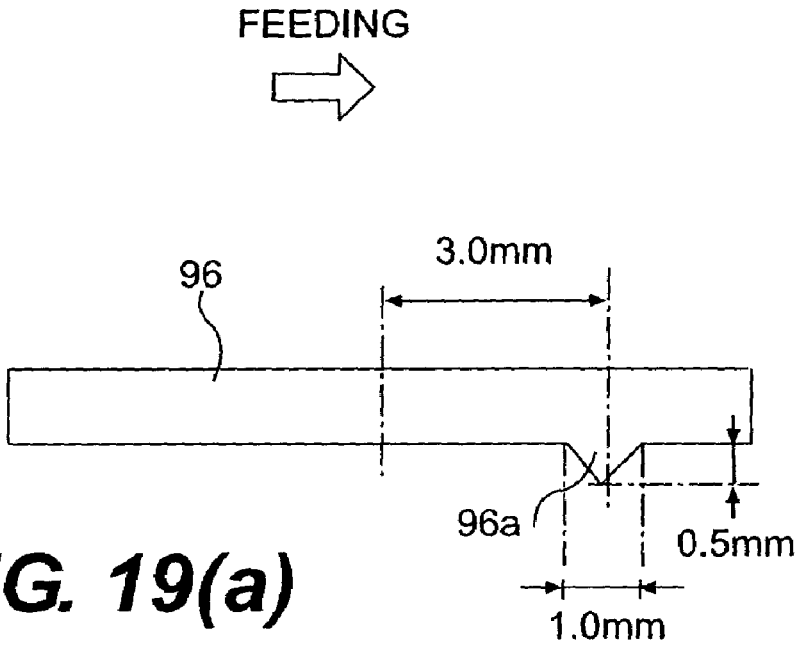
FIG. 19(*a*) is a schematic sectional view of the slippery member of the fixing apparatus in the fourth embodiment of the present invention, showing the structure thereof, and FIG. 19(*b*) is a graph showing the pressure distribution in the fixing nip, in the fourth embodiment.
Figure 19B:
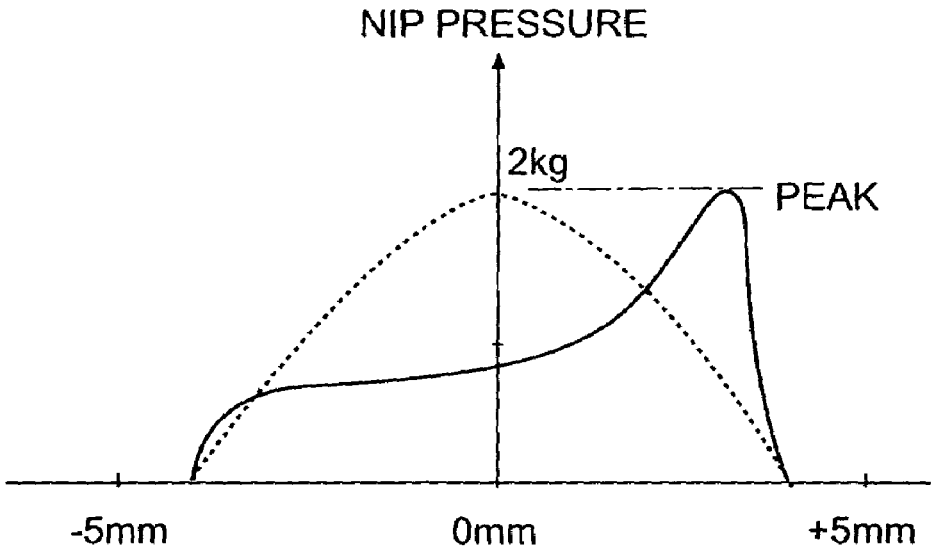

Referring to FIG. 19(*b*), the highest pressure generated in the fixation nip N between the slippery plate 96 provided with the ridge 96*a*, and the pressure roller 97, is the same as the pressure generated in the fixation nip N between the slippery plate 96 with no ridge, and the pressure roller 97. However, the position of the point at which the highest pressure is generated with the slippery plate 96 with the ridge 96*a*, is 4 mm downstream of the center of the fixation nip N, in terms of the recording medium advancement direction, making it possible that, within the upstream half of the fixation nip N, the toner is heated while being subjected to relatively weak pressure; in other words, the toner is pre-heated.

Then, within the downstream half of the fixation nip N, the aforementioned highest pressure (peak pressure) is applied to the pre-heated (melted) toner, substantially reducing thereby the amount by which the toner transfer ("hot offset") onto the fixation sleeve when the recording medium separates from the fixation sleeve. In other words, the possibility of the occurrence of "hot offset" in the aforementioned high temperature range is virtually eliminated, making it possible to accomplish a glossiness level higher than the glossiness level attainable with the use of the conventional fixating apparatus.

In particular, when a toner with a higher MI is used to achieve a higher level of glossiness as in this embodiment, it is harder to prevent "hot offset". Therefore, using the fixing apparatus, which generates the higher fixation pressure in the downstream half of the fixation nip, along with the toner with a higher MI, is highly effective to achieve a high level of glossiness. The MI range for toner, which is preferable for a toner to be used with the fixing apparatus in this embodiment, is 3–50. When a toner with an MI value of no more than 3 is used, it is difficult to achieve a high level of glossiness, even if the fixing apparatus in this embodiment is employed. On the other hand, in the case of a toner with an MI value of no less than 50, a high level of glossiness can be achieved by the toner alone, that is, even if the fixing apparatus in this embodiment is not employed along with the toner.

Figure 21:
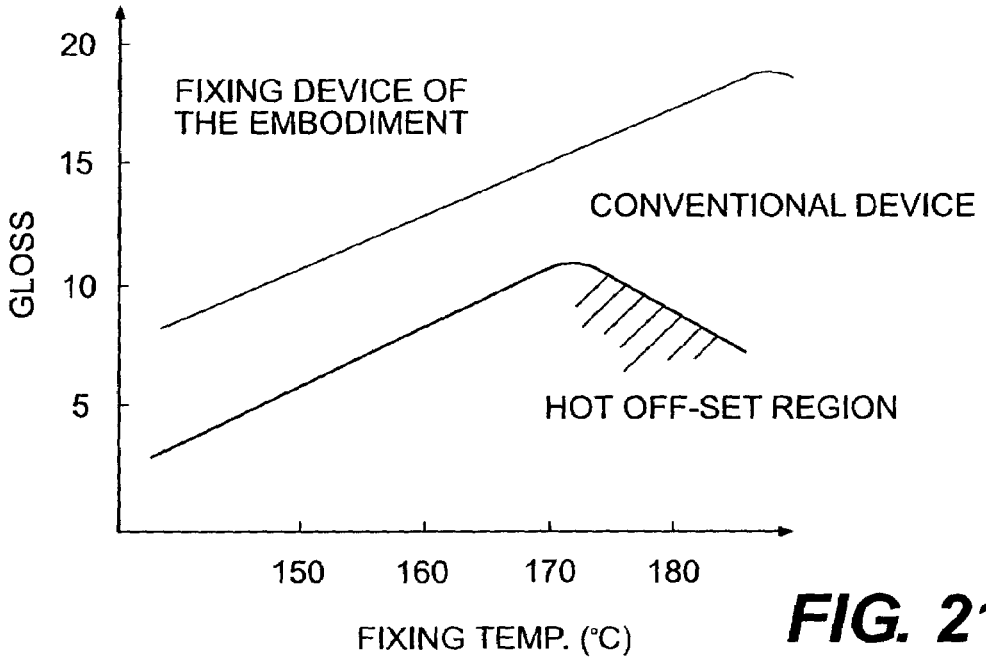
FIG. 21 is a graph presenting the concept of the glossiness level curve in the fourth embodiment of the present invention.

More concretely, referring to FIG. 21, the highest level of glossiness achievable with the use of a conventional fixing apparatus, which generates its highest fixation pressure at the center of the fixation nip, is roughly 12, which is the glossiness level achieved at the fixation temperature of 170° C.

In comparison, in the case of the fixing apparatus in this embodiment, "hot offset" does not occur even when the fixation temperature is 185° C., making it possible to achieve a glossiness level of roughly 20.

As described above, in this embodiment, the fixing apparatus is structurally configured so that the highest fixation pressure is generated in the downstream half of the fixation nip, making it possible to set the fixation temperature to a higher level. Thus, it becomes possible to achieve a higher level of glossiness unattainable with the use of a conventional fixing apparatus, by forming toner images on a recording medium, with the use of toners higher in MI (no less than 3 and no more than 50), and fixing the unfixed toner image on the recording medium, with the use of the fixing apparatus in this embodiment, so that "hot offset" is prevented.

Embodiment 5

This embodiment is characterized in that, in order to achieve a high level of glossiness by using a toner higher in glass transition point, a fixing apparatus, which generates its highest fixation pressure, in the downstream half of its fixation nip, is used to fix toner images at a higher temperature.

Generally, in the case of a developing method, such as a single-component contact type developing method, in which toner particles become charged due to the presence of vigorous shear, heat is generated by the shear and friction which occur between the toner supply roller and development roller, and/or between the development roller and photosensitive drum, creating the problem that the toner is deteriorated by this heat.

More concretely, the toner particles are softened by the frictional heat, being thereby deformed by the shear (kinetic force which acts to shear toner particles: force which acts to crush toner particles), and/or the external additive particles, for example, silica particles or the like, are pressed into the toner particles, deteriorating thereby the toner (toner particles).

Regarding the phenomenon that the hardness of the toner particles is affected by ambient temperature, the glass transition point of the toner, at which the resin binder of the toner changes in phase, can be used as one of the criteria for choosing a toner.

The glass transition point (Tg) of the ordinary toner is in the range of 40–80° C. However, in the case of a system which employs a contact developing method, a toner, the glass transition point (Tg) of which is no less than 55° C., is frequently used.

Even if the internal temperature of a developing apparatus does not exceed the glass transition point (Tg), it is possible that the internal temperature, in microscopic terms, of the developing apparatus, that is, the temperature in the adjacencies of a given toner which is being subjected to friction, sometimes nears the glass transition point (Tg). Therefore, when a contact developing method is employed, it is desired that a toner with a higher glass transition point (Tg) is used.

Generally speaking, the glass transition point (Tg) is related to the number of the cross-links of the binder. The greater the number of the cross-links, the more difficult it is for the principal chain of the toner to move, and therefore, the higher the temperature necessary to melt the toner. In addition, a toner, such as the above described one, which is greater in the number of the cross-links, is low in fluidity when it is in the melted condition, although the level of the fluidity depends on the number of the cross-links. Thus, when a toner greater in the number of the cross-links is used, it is difficult to achieve a high level of glossiness.

In other words, when a toner higher in glass transition point (Tg) is used, a high level of glossiness is difficult to achieve unless fixation temperature is raised.

On the other hand, there is a correlation between "hot offset", which occurs when the fixation temperature is high, and the molecular weight of the resin binder of toner. Thus, even if a toner having a high glass transition point is used, it does not mean that it is assured that the fixation temperature can be raised.

More specifically, for a system which is intended to achieve a high level of glossiness while using a contact developing method, it is common practice to design a toner so that a resin, the principal chain of which has a small molecular weight, can be used in order to achieve a high level of glossiness, and also that the cross-links among the principal chains can be increased in order to prevent the toner deterioration for which the contact developing method is responsible. In the case of such a toner, its high glass transition point effected by the large number of cross-links, and its high MI is effected by the fluidity of the toner in the melted condition.

In this case, in order to assure that a toner with a large number of cross-links is melted, there is no other way but using a fixation temperature higher than that used when a toner, such as a toner used when a two-component developing method is employed, which has a lower glass transition point. On the other hand, as a toner with a large number of cross-links melts, its fluidity drastically reduces. In other words, a toner with a large number of cross-links is such a toner that its usage makes it difficult to control "hot offset".

Figure 22:
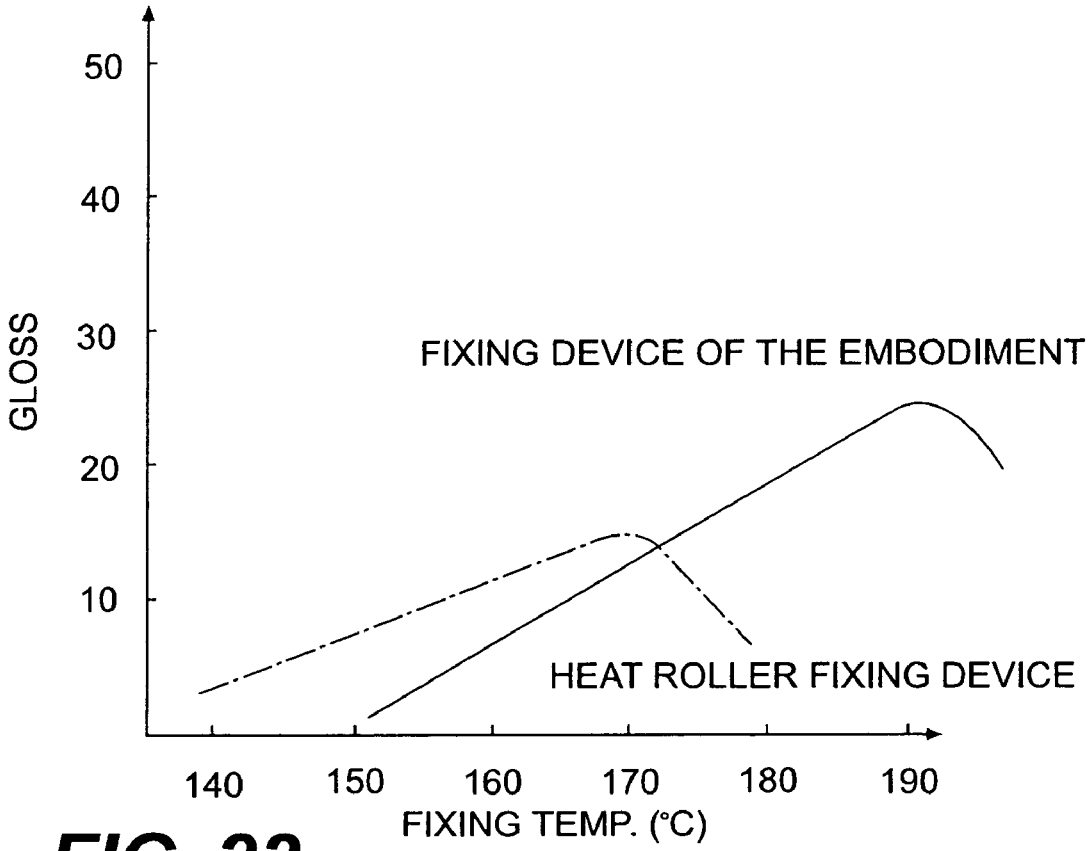
FIG. 22 is a graph presenting the concept of the glossiness level curve in the fifth embodiment of the present invention.

In other words, a toner with a large number of cross-links is characterized in that when it is used, the fixation temperature range in which a high level of glossiness can be achieved is extremely narrow, as shown in FIG. 22; the toner is peaky in properties.

In order to expertly use such a toner, a fixing apparatus which is small in temperature ripple, and superior in terms of "hot offset", is necessary.

Thus, a high level of glossiness can be achieved by combining the on-demand type fixing apparatus, in the first embodiment, which employs the method for generating heat by induction, and which is structured so that the point in the fixation nip, at which the fixation pressure is highest, is placed on the downstream side of the center of the fixation nip, being therefore superior in terms of "hot offset".

Regarding the usage of a toner, the glass transition point (Tg) of which is no less than 50° C., when such a toner is used, a high level of glossiness can be achieved by the toner alone, simply by employing a developing method capable of carrying out a development process without subjecting the toner to stress. Therefore, the usage of such a toner has little to do with the gist of the present invention.

When a toner, the glass transition point of which is higher than 80° C., is used, it is intrinsically difficult to achieve the high level of glossiness aimed for by the present invention.

Hereinafter, a concrete example will be described.

The image forming apparatus in this embodiment is roughly the same as the one in the fourth embodiment, except that the apparatus in this embodiment employs a single-component developing method.

The developing apparatus comprises a development roller and a development blade. The development roller is 16 mm in diameter and is formed of elastic rubber, the electrical resistance of which is in the medium range, and the development blade is a piece of thin metallic plate coated with nylon. The development sleeve is directly pressed on the peripheral surface of the photosensitive drum, being thereby compressed by 0.5 mm by the photosensitive drum in terms of the diameter direction thereof, and therefore, forming a contact nip. In operation, toner is coated on the peripheral surface of the development roller, which is being rotated in the same direction as the photosensitive drum, at such a peripheral velocity that is 170% of that of the photosensitive drum, and DC voltage is applied to the development roller. As a result, a latent image on the peripheral surface of the photosensitive drum is developed by the toner on the peripheral surface of the development roller.

Since the development roller is rotated at 170% of the peripheral velocity of the photosensitive drum while remaining compressed by the photosensitive drum, the toner particles in the development nip are subjected to very strong shearing force, and also, a substantial amount of heat is generated by friction, in the development nip. Thus, a toner having a glass transition point of 65° C. is employed.

With the provision of the above described structural arrangement, and also, the employment of a toner with a high glass transition point, even if a single-component contact developing method is employed, it is possible to continuously produce a large number of prints of preferable quality, without causing toner to deteriorate despite of the extended usage.

FIG. 22 shows the results of the image forming operations carried out with the combination of the above described development system and the fixing apparatus in the fourth embodiment.

With the use of a toner with a high glass transition point, the temperature, above which glossiness increases due the melting of toner, increased to 30° C., and the level of glossiness achieved by the combination was slightly lower that achieved, at the same fixation temperature, by an ordinary fixing apparatus which employs a heat roller.

In the case of an ordinary fixing apparatus which employs a heat roller, the point in the fixation nip, at which the internal pressure of the fixation nip is highest, coincides with the center of the fixation nip. Therefore, when the fixation temperature is no less than 170° C., "hot offset" occurs, reducing the level of glossiness, as shown by the single-dot chain line in FIG. 22. In other words, the highest level of glossiness achievable with the use of the ordinary fixing apparatus is 15.

Further, in the case of a heat roller type fixing apparatus, a recording medium is heated by the heat of a heat roller, and the amount of the heat which can be supplied by the heat roller is affected by the thermal capacity of the heat roller. Therefore, the temperature at which fixation occurs fluctuates as much as 30° C., while recording mediums are continuously conveyed through the fixation nip.

More specifically, when the fixation temperature is set to 170° C., the surface temperature of the heat roller after the continuous passage of 10 recording mediums will be no more than 140° C., and therefore, the level of glossiness achievable will be no more than 5, making it impossible to produce a color print of good quality.

In comparison, in the case of the combination of the above described toner and the on-demand type fixing apparatus employing an induction heating method, in this embodiment, the temperature drop which may be caused by the continuous feeding of recording mediums is no more than 5° C. (a maximum of 5° C.), and in addition, the point in the fixation nip, at which the fixation pressure is highest, is in the downstream side of the fixation nip, raising thereby the temperature, above which "hot offset" occurs, to 190° C. Therefore, it is assured that a glossiness level of 25 can be achieved regardless of printing conditions.

As described above, in this embodiment, an unfixed image formed of a toner, the glass transition point (Tg) of which is no less than 50° C. and no more than 80° C., more specifically, a toner with a glass transition point of no less than 60° C., on a recording medium, is fixed with the use of an on-demand type fixing apparatus, in which the point in the fixation nip, at which the fixation pressure is highest, is in the downstream side of the fixation nip. Therefore, "hot offset" is prevented, making it possible to always achieve a high level of glossiness, regardless of the development method.

Embodiment 6

This embodiment is characterized in that a high level of glossiness is achieved by combining an image forming apparatus having a high gloss mode, in which the glossiness value, which indicates the glossiness level of an image formed on a recording medium, is greater than that in the normal mode, with a fixing apparatus, in which the point in the fixation nip, at which the fixation pressure is highest, is in the downstream side of the fixation nip.

It is true that a highly glossy image is generally a high quality image. However, in the field of a business document, which contains letters as well as photographic pictures, a high level of glossiness is not always preferred.

In the field of a business document, a low level of glossiness, more specifically, a glossiness level of no more than 10, which is virtually the standard glossiness level for conventional black-and-white printer or copying machines, is the familiar glossiness level. In other words, it is also true that an excessively high level of glossiness is not preferred because of the glare resulting therefrom.

Thus, it is desired that an image forming apparatus is provided with a glossiness control function, which makes it possible to choose between a high level of glossiness and a low level of glossiness, as necessary.

In order to realize an image forming apparatus with such a function, it is necessary for an image forming apparatus to be enabled to operate in a low gloss mode and a high gloss mode. The low gloss mode is the normal mode which is easier to provide in technological terms, whereas the high gloss mode is a mode which may be selected when outputting an photographic image or the like, to achieve a high level of glossiness.

Generally speaking, lowering the fixation speed is likely to raise the highest level of achievable glossiness. On the other hand, lowing the fixation speed lowers the fixation temperature at which the highest level of glossiness can be achieved, and also, narrows the fixation temperature range in which a high level of glossiness can be achieved; a fixing apparatus becomes "peaky" in the fixation pressure distribution graph.

In other words, in order for an image forming apparatus to operate in a special mode in which a high level of glossiness is achieved by slowing the fixation speed, the apparatus needs to be equipped with a fixing apparatus which is superior in terms of "hot offset", and is smaller in the temperature fluctuation.

This embodiment is characterized in that an image forming apparatus capable of operating in the normal mode, and a high gloss mode in which the level of glossiness, at which an image is formed on a recording medium, is higher than that in the normal mode, and in which the fixation speed is lower than that in the normal mode, is controlled, in glossiness level, by equipping the image forming apparatus with a fixing apparatus, in which the point in the fixation nip, at which the fixation pressure is highest, is in the downstream side of the fixation nip.

Next, this embodiment will be more concretely described.

The image forming apparatus in this embodiment is the same as the one in the fourth embodiment, except for the fixing apparatus thereof.

The fixing apparatus in this embodiment is basically the same as the one in the fourth embodiment, except for the structural arrangement for making the fixation pressure highest in the downstream side of the fixation nip.

Providing a slippery plate with a ridge, as in the fourth embodiment, is the simplest way to increase pressure at a given point in the fixation nip. However, the ridge is strenuously rubbed by the inward surface of the circularly moving sleeve, creating the problem that the inward surface of the sleeve, and the ridge, are worn by friction. Further, while the sleeve is circularly moved, it is bent against its normal curvature, increasing thereby the torque necessary to move the sleeve. As a result, the sleeve sometimes becomes irregular in speed, and/or abnormal noises sometimes occur. In addition, there is the problem that the sleeve breaks due to the fatigue caused by the above described bending.

In comparison, referring to FIG. 16(*b*), in this embodiment, the fixing apparatus is provided with a member (slippery member) for simply facilitating the movement of the sleeve 91 while supporting it, and a backup roller (rotational member) with a small diameter, in order to solve the above described problem. In terms of the recording medium advancement direction, the supporting member, that is, a slippery member, is disposed on the upstream side of the center of the fixation nip, and the backup roller is disposed on the downstream side of the center of the fixation nip. The back roller is placed in contact with the inward surface of the sleeve 91.

In this embodiment, the supporting member (guiding member) 111 on the upstream side of the center of the fixation nip is formed of heat-resistant liquid crystal polymer. This, however, does not mean that the material and structural configuration for the supporting member 111 is to be limited to those described above. For example, the supporting member 111 may be replaced with a guiding roller with a small diameter to further reduce the friction.

For heat insulation, a PFA resin roller with a diameter of 4 mm is used as the backup roller 99 to be placed on the downstream side of the center of the fixation nip, in this embodiment. The backup roller 99 is placed in contact with a metallic roller 110 with a diameter of 12 mm, which is placed inward of the loop of the sleeve 9, relative to the backup roller 99, and presses on the backup roller 99 across the entire range thereof, in terms of the lengthwise direction.

With the provision of the above described structural arrangement, the friction and wear are further reduced, assuring that the point in the downstream side of the fixation nip, at which the fixation pressure is highest when the fixing apparatus is put to use for the first time, remains as the point at which the fixation pressure is highest, throughout virtually the entirety of the service life of the apparatus.

Figure 24A:
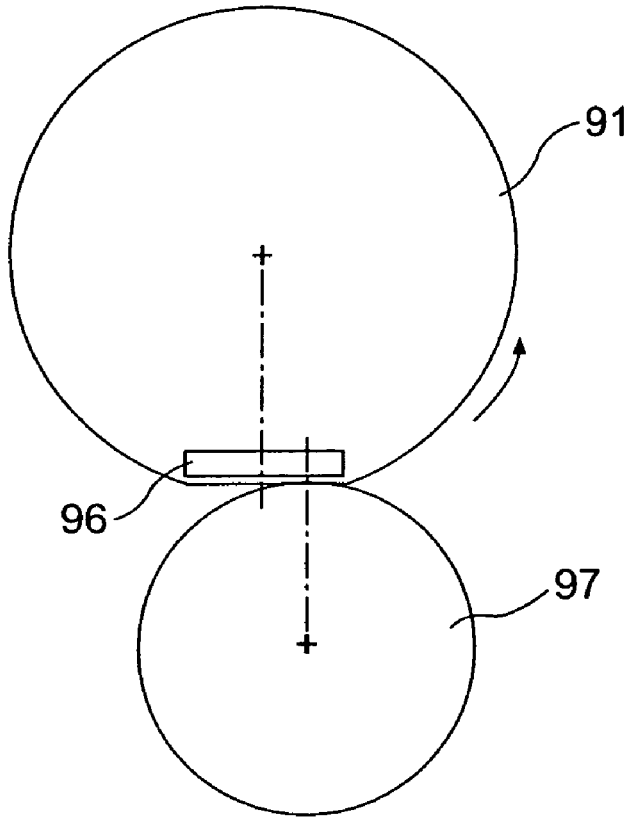
FIG. 24(*a*) is a schematic sectional view of the fixing apparatus in the sixth embodiment of the present invention, and FIG. 24(*b*) is a schematic sectional view of the slippery member of the fixing apparatus in the sixth embodiment of the present invention.
Figure 24B:
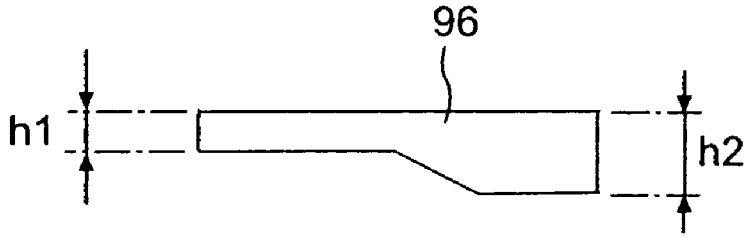

There are other methods for making the fixation pressure highest on the downstream side of the fixation nip, in a conventional on-demand type fixing apparatus. For example, it is possible to position the pressure roller 97 so that the center of the fixation nip will be positioned a certain distance downward of the widthwise center of the slippery member 96, as shown in FIG. 24(*a*), or to construct the slippery member 96 so that the thickness h1 of the upstream half of the slipper member 96 is less than the thickness h2 of the downstream half, as shown in FIG. 24(*b*). The employment of these methods does not contradict the gist of the present invention.

Next, an example of an image forming operation carried out with the above described image forming apparatus, in the high gloss mode, will be described.

The host computer is configured so that a user can select the high gloss mode from the printer driver menu. As a user selects the high gloss mode, the printer reduces its fixation speed, and switches its fixation temperature to the high gloss mode temperature, which is different from that for the normal gloss mode, in order to fix an image at the optimum temperature.

The temperature level to which the fixation temperature is set for the high gloss mode is affected by the types of toner and recording medium used by a given image forming apparatus; it may be raised or lowered. In this embodiment, in order to achieve a high level of glossiness, the fixation speed is reduced, and therefore, the fixation temperature is reduced to prevent toner from "hot offsetting".

More concretely, in this embodiment, as this print mode is selected, the entirety of the image formation system, inclusive of the fixing apparatus, is reduced to ⅓ in process speed, and the fixation temperature is reduced to 180° C. from that in the preceding embodiments.

Figure 23:
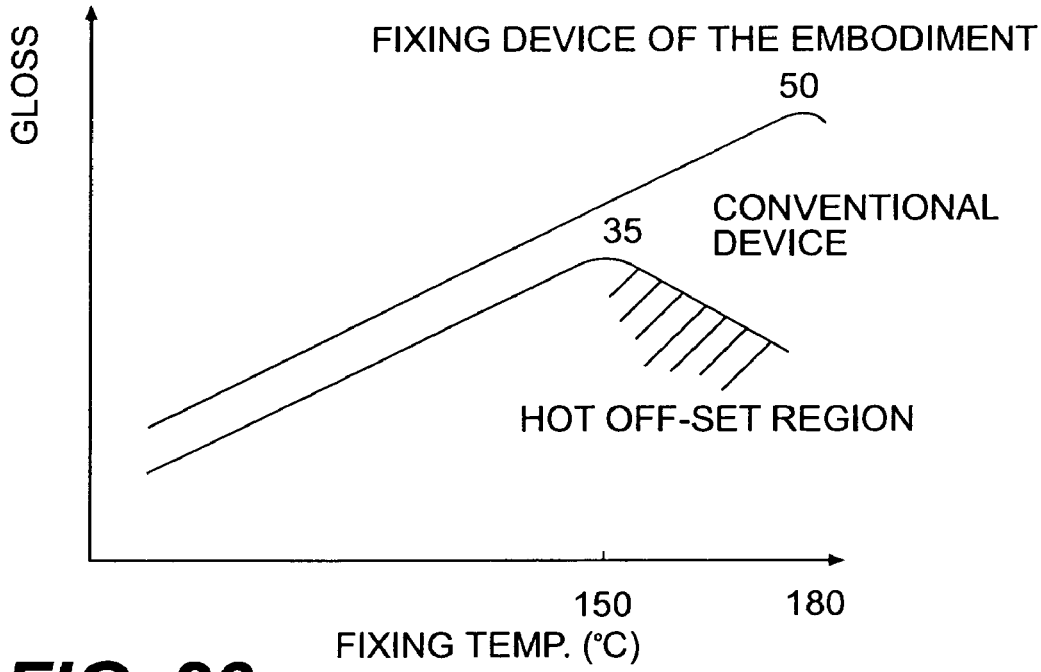
FIG. 23 is a graph showing the concept of the glossiness level curve in the sixth embodiment of the present invention.

Referring to FIG. 23, in the case of a conventional fixing apparatus, as the fixation speed is reduced to ⅓, the threshold of "hot offset" reduces to as low as 150° C. Therefore, the highest level of glossiness achievable by a conventional fixing apparatus was roughly 35 even when the apparatus was in the high gloss mode. In the case of a fixing apparatus, such as the fixing apparatus in this embodiment, the threshold of which for "hot offset" is much higher, and therefore, a glossiness level as high as 50 can be achieved by using a fixation temperature of 180° C.

As described above, this embodiment makes it possible to achieve a high level of glossiness, by preventing "hot offset" by combining an image forming apparatus having a printing mode in which a high level of glossiness can be achieved, with a fixing apparatus, in which the point in the fixation nip, at which the fixation pressure is highest, is in the downstream side of the fixation nip relative to the center of the fixation nip.

Miscellaneous Embodiments

The preceding embodiments were described with reference to the combination of the toner, the MI of which is no less than 3 and no more than 50, and the glass transition point of which is no less than 50° C. and no more than 80° C. and the fixing apparatus, in which the point in the fixation nip, at which the fixation pressure is highest, is in the downstream side of the nip relative to the center of the nip, in terms of the recording medium advancement direction. This does not mean that the application of the present invention is to be limited to the above combination. In other words, the present invention is also applicable to the combination of the above described toner having both of the above described properties, with the fixing apparatus structure as described above. For example, the same effects can be obtained by combining: a contact type developing method; a toner, the MI of which is no less than 3 and no more than 40, and the glass transition point of which is no less than 55° C. and no more than 80° C.; and the fixing apparatus, in which the point in the fixation nip, at which the fixation pressure is highest, is in the downstream side of the nip, relative to the center of the nip, in terms of the recording medium advancement direction.

Also, the preceding embodiments were described with reference to a printer as an image forming apparatus. This does not mean that the application of the present invention is to be limited to a printer. In other words, the present invention is also applicable to a copying machine, a facsimileing machine, etc., that is, an image forming apparatus other than a printer, as well as a multifunctional image forming apparatus capable of performing the functions of the preceding image forming apparatuses. Further, the present invention is also applicable to an image forming apparatus which employs an intermediary transfer medium, and in which toner images different in color are transferred in layers onto the intermediary transfer medium, and then, are transferred all at once from the intermediary transfer medium, onto a recording medium. In other words, the effects similar to the above described ones can be obtained also by equipping any of the above listed image forming apparatuses with a fixing apparatus in accordance with the present invention.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus for heating an image formed on a recording material, comprising:

a flexible rotatable member;

a slidable member for sliding contact with an inner surface of said flexible rotatable member;

a back-up member for forming a nip with said slidable member with said flexible rotatable member interposed therebetween, wherein the nip is effective to nip and feed the recording material, and the image is heated by heat supplied from said flexible rotatable member;

a second rotatable member disposed within the range of said nip and downstream of said slidable member with respect to the recording material feeding direction, wherein said second rotatable member is effective to provide a maximum pressure in the direction, with respect to the recording material feeding direction, of pressure applied to the nip.

2. An apparatus according to claim 1, wherein said flexible rotatable member includes a metal layer, and said apparatus comprises magnetic field generating means for generating heat by electromagnetic induction in the metal layer of said flexible rotatable member.

3. An apparatus according to claim 1, wherein said apparatus is usable with an image forming apparatus for forming a toner image on the recording material, wherein the toner has a Melt Index of 3–50.

4. An apparatus according to claim 1, wherein said apparatus is usable with an image forming apparatus for forming a toner image on the recording material, wherein the toner has a glass transition point of 50–80 Centigrade.

* * * * *

UNITED STATES PATENT AND TRADEMARK OFFICE

CERTIFICATE OF CORRECTION

PATENT NO. : 7,010,256 B2
APPLICATION NO. : 10/705975
DATED : March 7, 2006
INVENTOR(S) : Masatake Usui et al.

It is certified that error appears in the above-identified patent and that said Letters Patent is hereby corrected as shown below:

COLUMN 1:
Line 42, “tuses” should read --tus--.
Line 61, “soling” should read --soiling--.

COLUMN 5:
Line 58, “number)” should read --member)--.
Line 65, “PvdF” should read --PvdF--.

COLUMN 8:
Line 65, “PPA” should read --PFA--.

COLUMN 12:
Line 7, “layer L” should read --layer t--.

COLUMN 15:
Line 7, “stops,” should read --stopped,--.

COLUMN 16:
Line 58, “place don” should read --placed on--.

COLUMN 18:
Line 64, “are” should read --is--.

COLUMN 24:
Line 45, “due” should read --due to--.
Line 47, “lower” should read --lower than--.

COLUMN 25:
Line 58, “an” should read --a--.
Line 62, “lowing” should read --slowing--.

UNITED STATES PATENT AND TRADEMARK OFFICE

CERTIFICATE OF CORRECTION

PATENT NO. : 7,010,256 B2
APPLICATION NO. : 10/705975
DATED : March 7, 2006
INVENTOR(S) : Masatake Usui et al.

It is certified that error appears in the above-identified patent and that said Letters Patent is hereby corrected as shown below:

COLUMN 27:
Line 12, "slipper" should read --slippery--.

Signed and Sealed this

Twenty-third Day of January, 2007

JON W. DUDAS
*Director of the United States Patent and Trademark Office*